US010851603B2

(12) United States Patent
Kash

(10) Patent No.: US 10,851,603 B2
(45) Date of Patent: Dec. 1, 2020

(54) SLIPS FOR DOWNHOLE SEALING DEVICE AND METHODS OF MAKING THE SAME

(71) Applicant: G&H Diversified Manufacturing LP, Houston, TX (US)

(72) Inventor: Edward Cannoy Kash, Houston, TX (US)

(73) Assignee: G&H Diviersified Manufacturing LP, Houston, TX (US)

( * ) Notice: Subject to any disclaimer, the term of this patent is extended or adjusted under 35 U.S.C. 154(b) by 189 days.

(21) Appl. No.: 15/422,332

(22) Filed: Feb. 1, 2017

(65) Prior Publication Data

US 2017/0218711 A1 Aug. 3, 2017

Related U.S. Application Data

(60) Provisional application No. 62/289,489, filed on Feb. 1, 2016.

(51) Int. Cl.

| | |
|---|---|
| ***E21B 33/129*** | (2006.01) |
| ***E21B 23/01*** | (2006.01) |
| ***B22D 19/04*** | (2006.01) |
| *B22D 19/00* | (2006.01) |

(52) U.S. Cl.

CPC ..... *E21B 23/01* (2013.01); *B22D 19/04* (2013.01); *E21B 33/129* (2013.01); *E21B 33/1293* (2013.01); *B22D 19/00* (2013.01)

(58) Field of Classification Search

CPC combination set(s) only.

See application file for complete search history.

(56) References Cited

U.S. PATENT DOCUMENTS

| | | | | |
|---|---|---|---|---|
| 1,508,882 | A * | 9/1924 | Hosmer | E21B 19/10 175/423 |
| 2,877,850 | A * | 3/1959 | Burns | E21B 43/10 166/124 |
| 3,843,167 | A * | 10/1974 | Gronstedt | F16L 17/10 285/18 |
| 4,311,196 | A * | 1/1982 | Beall | E21B 33/129 166/134 |
| 4,440,223 | A | 4/1984 | Akkerman | |
| 4,823,919 | A * | 4/1989 | Hayatdavoudi | E21B 19/10 188/244 |
| 5,224,540 | A | 7/1993 | Streich et al. | |
| 5,271,468 | A | 12/1993 | Streich et al. | |
| 6,708,768 | B2 | 3/2004 | Slup et al. | |
| 6,976,534 | B2 * | 12/2005 | Sutton | E21B 33/129 166/118 |
| 2009/0084516 | A1 * | 4/2009 | Fothergill | B22D 19/00 164/110 |

(Continued)

OTHER PUBLICATIONS

International Search Report and Written Opinion dated Apr. 26, 2017, for International Patent Application No. PCT/US2017/016086.

*Primary Examiner* — Taras P Bemko
*Assistant Examiner* — Ronald R Runyan
(74) *Attorney, Agent, or Firm* — Conley Rose, P.C.

(57) ABSTRACT

A slip for a downhole sealing device includes a plurality of slip segments angularly disposed about a central axis, each slip segment including, a body, and a plurality of engagement members molded or cast at least partially within the body, wherein each of the slip segments are releasably coupled to one another.

21 Claims, 22 Drawing Sheets

(56) References Cited

U.S. PATENT DOCUMENTS

| | | | | |
|---|---|---|---|---|
| 2011/0036561 | A1* | 2/2011 | Bishop | E21B 33/1216 166/134 |
| 2011/0265986 | A1 | 11/2011 | Porter et al. | |
| 2014/0196889 | A1* | 7/2014 | Oberg | E21B 23/01 166/206 |
| 2014/0231069 | A1* | 8/2014 | Vanlue | E21B 33/128 166/181 |
| 2014/0262214 | A1 | 9/2014 | Mhaskar et al. | |
| 2014/0262344 | A1 | 9/2014 | Standridge | |
| 2015/0027737 | A1 | 1/2015 | Rochen et al. | |

* cited by examiner

SLIPS FOR DOWNHOLE SEALING DEVICE AND METHODS OF MAKING THE SAME

CROSS-REFERENCE TO RELATED APPLICATIONS

This application claims benefit of U.S. provisional patent application Ser. No. 62/289,489 filed Feb. 1, 2016, and entitled "Slips for Downhole Sealing Device and Methods of Making the Same," which is hereby incorporated herein by reference in its entirety.

STATEMENT REGARDING FEDERALLY SPONSORED RESEARCH OR DEVELOPMENT

Not applicable.

BACKGROUND

This disclosure generally relates to downhole sealing devices. More particularly, this disclosure relates to slips for engaging the inner surface of a casing or other tubular within a subterranean well to fix the position of the downhole sealing device.

During production operations for a subterranean wellbore (e.g., an oil or gas well), it is typically desirable to isolate one or more areas or sections of the subterranean wellbore from one another. To accomplish this isolation, downhole sealing devices (e.g., plugs, packers, etc.) are installed within the wellbore that sealingly engage with the inner surface of the casing or other tubular and therefore create a fluid tight boundary therein. Such downhole sealing devices typically include one or more slips that are actuated to engage with the inner surface of the downhole tubular to thereby fix the position of the sealing device therein against any differential pressure that may occur across the installed sealing device during production or other operations that occur thereafter.

SUMMARY

An embodiment of a slip for a downhole sealing device comprises a plurality of slip segments angularly disposed about a central axis, each slip segment including a body, and a plurality of engagement members molded or cast at least partially within the body, wherein each of the slip segments are releasably coupled to one another. In some embodiments, at least one of the engagement members is formed of a first material, and the body is formed of a second material that is different from the first material. In some embodiments, at least one of the engagement members comprises an arcuate segment. In certain embodiments, at least one of the engagement members comprises a cylindrical head including a planar engagement surface, and a base, wherein the base is embedded within the body, and wherein the planar engagement surface is disposed outside of body. In certain embodiments, at least one of the engagement members comprises a longitudinal member axis that extends radially with respect to the central axis, wherein the planar engagement surface is disposed at an angle less than 90° with respect to the member axis. In some embodiments, the body of each slip segment comprises a projection extending axially with respect to the central axis, wherein the body of each slip segment includes a slot extending axially with respect to the central axis, and wherein the projection of each slip segment is disposed in the slot of another of the slip segments. In some embodiments, the projection and the slot of the body of each slip segment is dovetail shaped. In certain embodiments, the projection of each slip segment is tapered, and wherein the slot of each slip segment is tapered. In certain embodiments, the projection of each slip segment includes an engagement member extending outward from a lateral side of the projection, wherein the slot of each slip segment includes an engagement receptacle extending inward from a lateral side of the slot, and wherein when the projection of each slip segment is inserted into the slot of another of the slip segments, the engagement member on the projection is seated within the engagement receptacle in the slot. In some embodiments, each slip segment comprises a plurality of the bodies, and a web extending between the plurality of bodies, wherein the web is monolithically formed with each of the plurality of bodies. In some embodiments, a radially inner end of the body comprises a receptacle, and an insert is received within the receptacle of the body.

An embodiment of a slip for a downhole sealing device comprises a plurality of separate and distinct slip segments angularly disposed about a central axis, each slip segment comprising a body formed of a first material, and an arcuate engagement member embedded within the body, the engagement member formed of a second material that is different from the first material. In some embodiments, the first material is harder than the second material. In some embodiments, the slip further comprises a plurality of the arcuate engagement members embedded within the body, wherein each arcuate engagement member extends arcuately about the central axis. In certain embodiments, the body of each slip segment includes a projection extending axially with respect to the central axis, wherein the body of each slip segment includes a slot extending axially with respect to the central axis, and wherein the projection of each slip segment is disposed in the slot of another of the slip segments. In certain embodiments, the projection and the slot of each slip segment are each tapered, the projection of each slip segment includes an engagement member extending outward from a lateral side of the projection, the slot of each slip segment includes an engagement receptacle extending inward from a lateral side of the slot, and when the projection of each slip segment is inserted into the slot of another of the slip segments, the engagement member on the projection is seated within the engagement receptacle in the slot. In some embodiments, the slip further comprises a plurality of elongate locking members, wherein the body of each slip segment includes a slot extending axially with respect to the central axis, and wherein the locking members are inserted into the slot of each slip segment. In some embodiments, each locking member comprises a pair of dovetail profiles and a throat disposed between the dovetail profiles, and one of the dovetail profiles of the locking members is inserted into the slot of each slip segment.

An embodiment of a method for manufacturing a slip for a downhole sealing device comprises (a) forming a plurality of engagement members from a first material, (b) placing the engagement members into a mold, (c) inserting a second material into the mold around the engagement members to form a slip segment, and (d) coupling the slip segment formed during (c) to another slip segment. In some embodiments, (c) comprises pouring a molten material into the mold. In some embodiments, the second material includes at least one of zinc, composite, and plastic. In certain embodiments, (a) comprises (a1) cutting a plurality of rings from a first material, and (a2) cutting each ring into a plurality of arcuate segments. In certain embodiments, (a) further comprises (a3) cutting one or more grooves into one or more of the arcuate segments. In some embodiments, (d) comprises inserting a projection on the slip segment into a slot of another slip segment. In some embodiments, (d) comprises axially inserting a separate locking member into a slot of each slip segment.

BRIEF DESCRIPTION OF THE DRAWINGS

For a detailed description of various exemplary embodiments, reference will now be made to the accompanying drawings in which.

DETAILED DESCRIPTION

Figure 1:
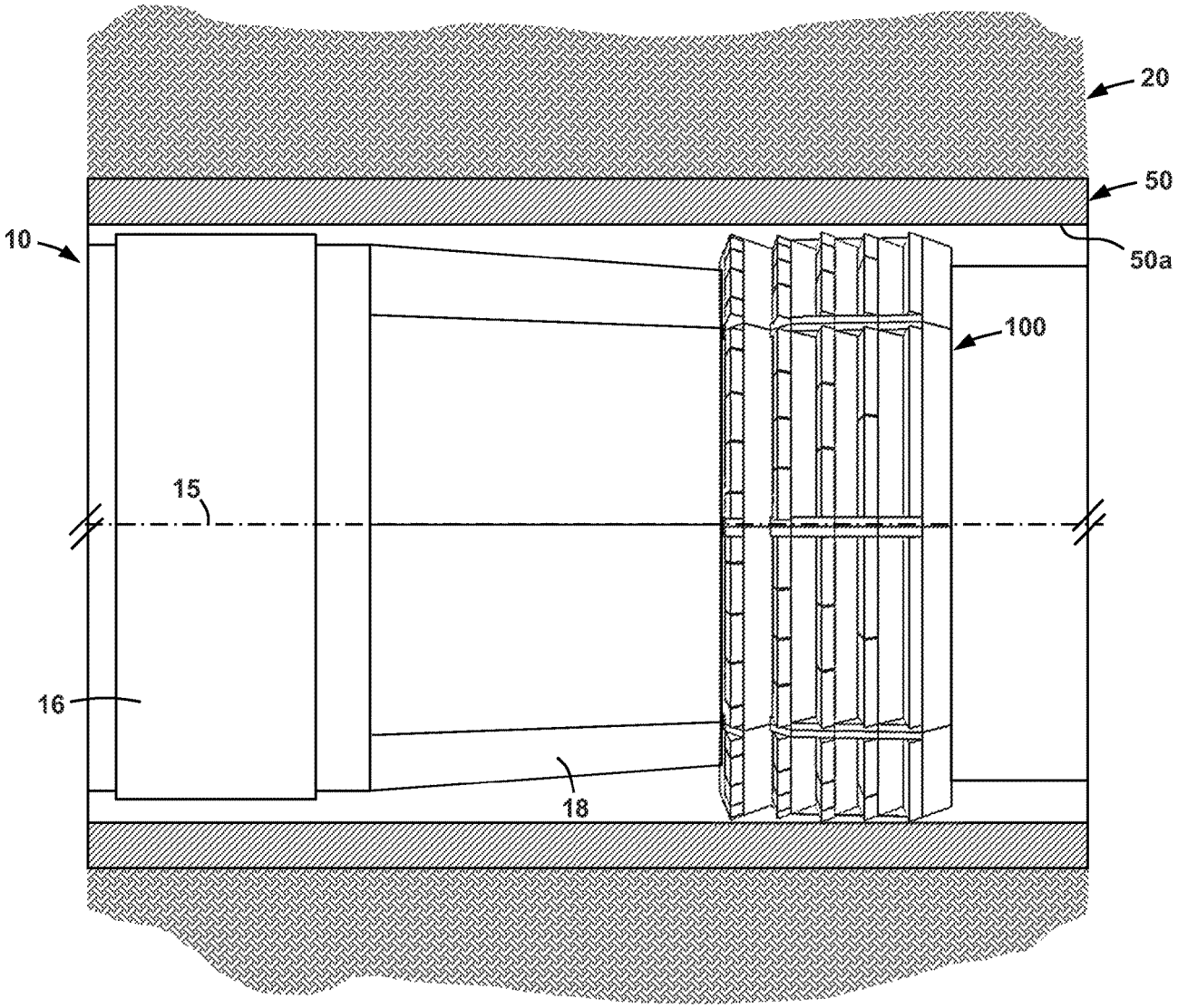
FIG. 1 is a side partial cross-sectional view of a downhole sealing device inserted within a tubular of a subterranean wellbore in accordance with at least some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

As previously described, downhole sealing devices typically include one or more slips that are actuated to engage with the inner surface of the downhole tubular to thereby fix the position of the sealing device therein against any differential pressure that may occur across the installed sealing device during production or other operations that occur thereafter. Specifically, during installation of the downhole sealing device, the one or more slips are radially expanded (typically by fracturing the slips at one or more locations) to allow teeth or other engagement features (e.g., buttons) on the slip to engage with the inner surface of the downhole tubular. Typically slips are milled from a solid piece of material (e.g., iron, steel, etc.). This manufacturing process is relatively lengthy and therefore expensive. Thus, embodiments disclosed herein include segmented slips for use on a downhole sealing device that comprise a plurality of individual, discrete slip segments that are pieced together to form the entire slip. In addition, manufacturing method for producing segmented slips in accordance with at least some embodiments are also disclosed herein.

Referring now to FIG. 1, a portion of a downhole sealing device 10 is shown disposed within a wellbore lined within a tubular 50 (e.g., a casing pipe) and extending within a subterranean formation 20. Downhole sealing device 10 may be any suitable device for deploying a sealing element to engage with the inner surface of a downhole tubular (e.g., tubular 50) to thereby isolate two or more regions within the tubular 50 from one another. In this embodiment, downhole sealing device 10 comprises a plug such as those used to isolate portions of the wellbore during, following, and/or preceding perforation (and/or fracturing) of the subterranean formation 20.

In this embodiment, sealing device 10 includes a central, longitudinal axis 15 and a sealing element 16 that is radially deployable (e.g., expandable) relative to axis 15 (e.g., by an explosive charge, hydraulic actuator, etc.) to sealingly engage with inner surface 50*a* of tubular 50 and thereby isolate one region (e.g., the region to the left of sealing element 16 in FIG. 1) from another (e.g., the region to the right of sealing element 16 in FIG. 1) within tubular 50. In addition, sealing device 10 also includes at least one slip 100 mounted downhole of sealing element 16 (e.g., to the left of element 16 as shown in FIG. 1) (Note: only one slip 100 is shown in FIG. 1 so as not to unduly complicate the figure; however, it should be appreciated that downhole sealing device 10 may include more than one slip in other embodiments). As will be described in more detail below, slip 100 is configured to be deployed or expanded radially relative to axis 15 to engage with inner surface 50*a* of tubular 50 and therefore fix the axial position of downhole sealing device 10 within tubular 50 during operations. Specifically, in this embodiment a tapered ram or mandrel 18 on downhole sealing device 10 is actuated axially toward slip 100 to engage with and thereby expand slip 100 radially outward toward inner surface 50*a*. In some embodiments, mandrel 18 is actuated axially relative to slip 100 with an explosive charge that is initiated with a detonation signal (e.g., electrical signal) routed from the surface. However, in other embodiments, mandrel 18 is actuated through some other method (e.g., hydraulic actuation).

Figure 2:
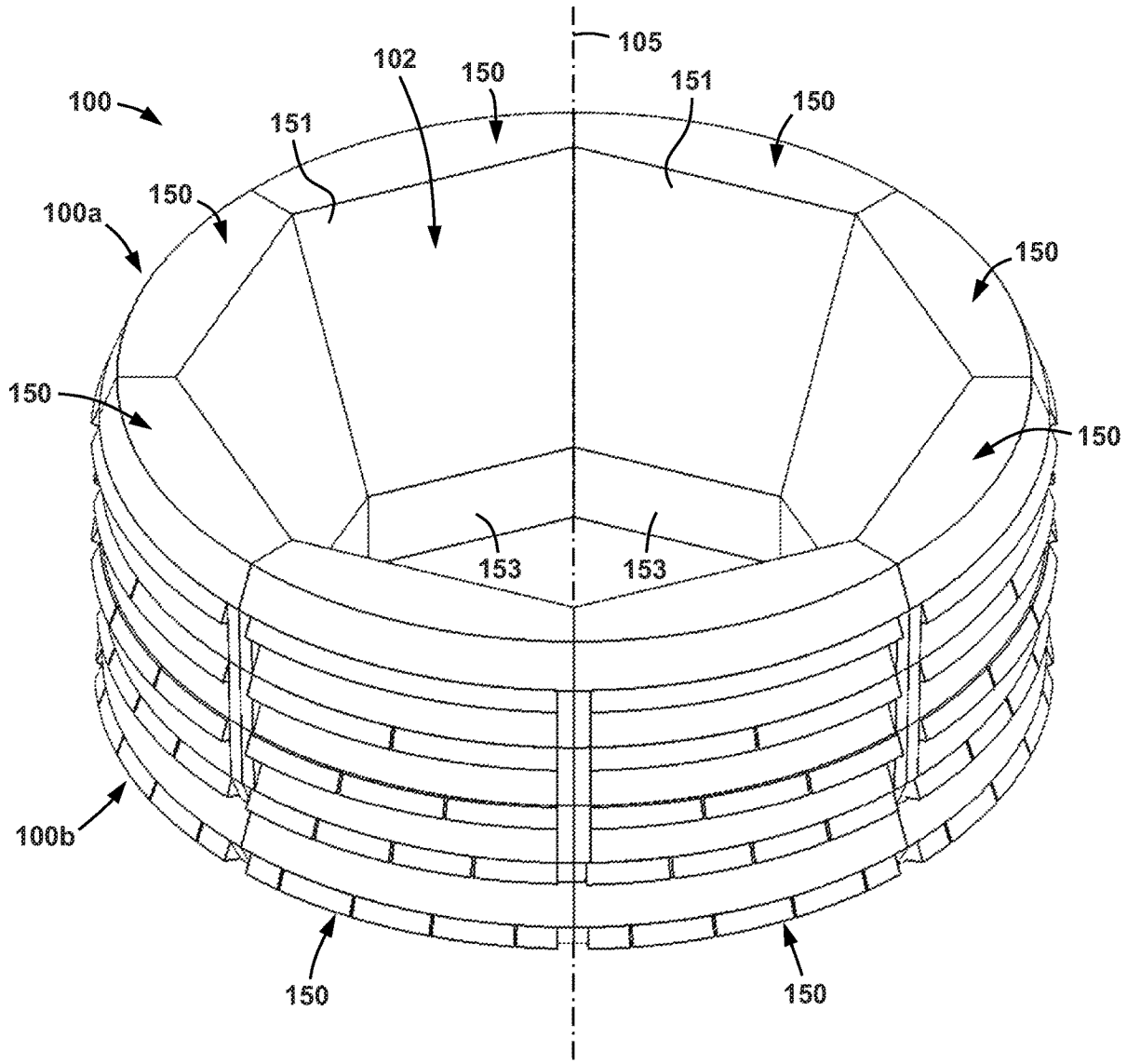
FIG. 2 is a perspective view of the slip of the downhole sealing device of FIG. 1 in accordance with at least some embodiments disclosed herein.
Figure 3:
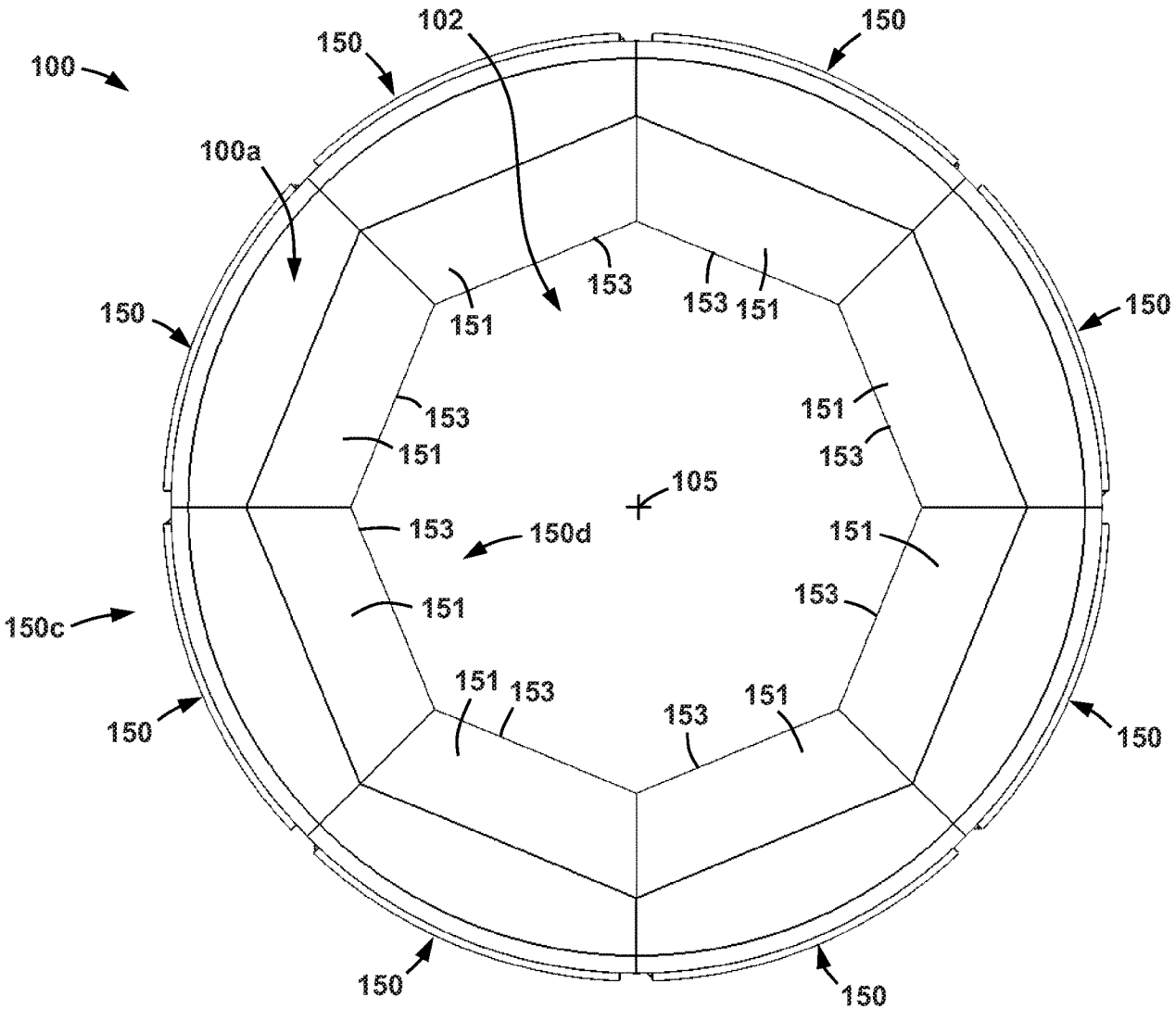
FIG. 3 is a top view of the slip of FIG. 2.
Figure 5:
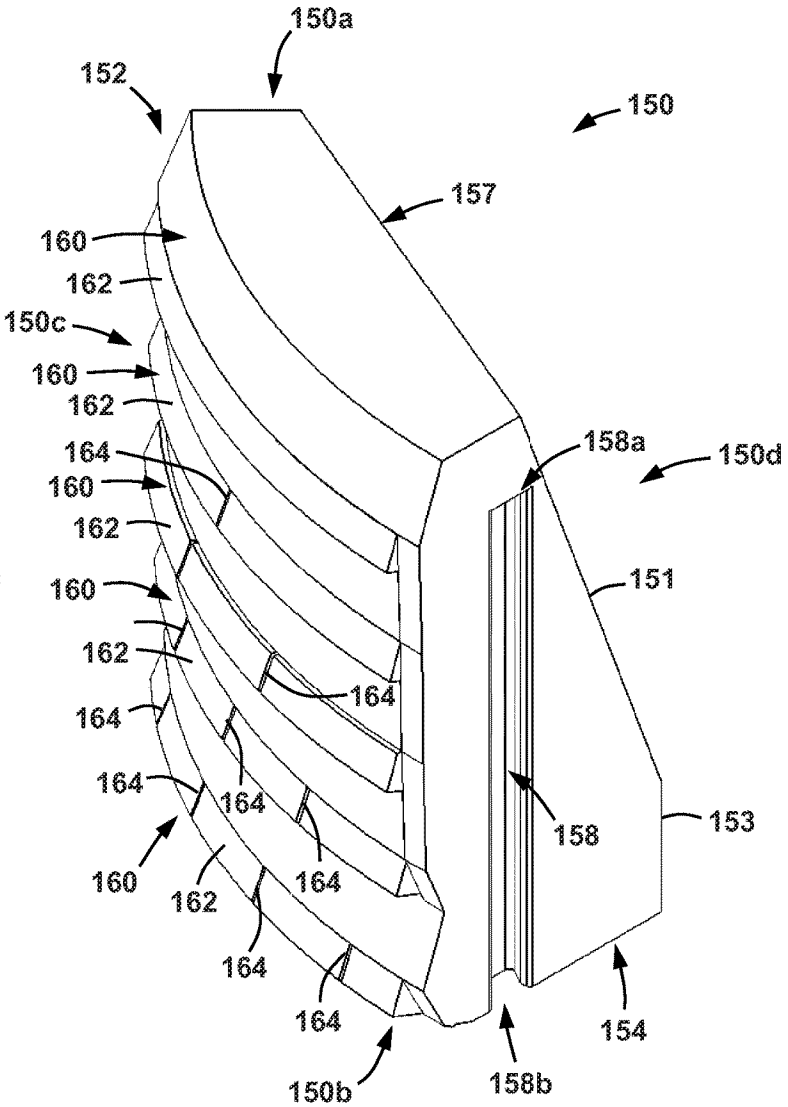
FIGS. 4 and 5 are perspective views of one of the slip segments of the slip of FIG. 2.
Figure 4:
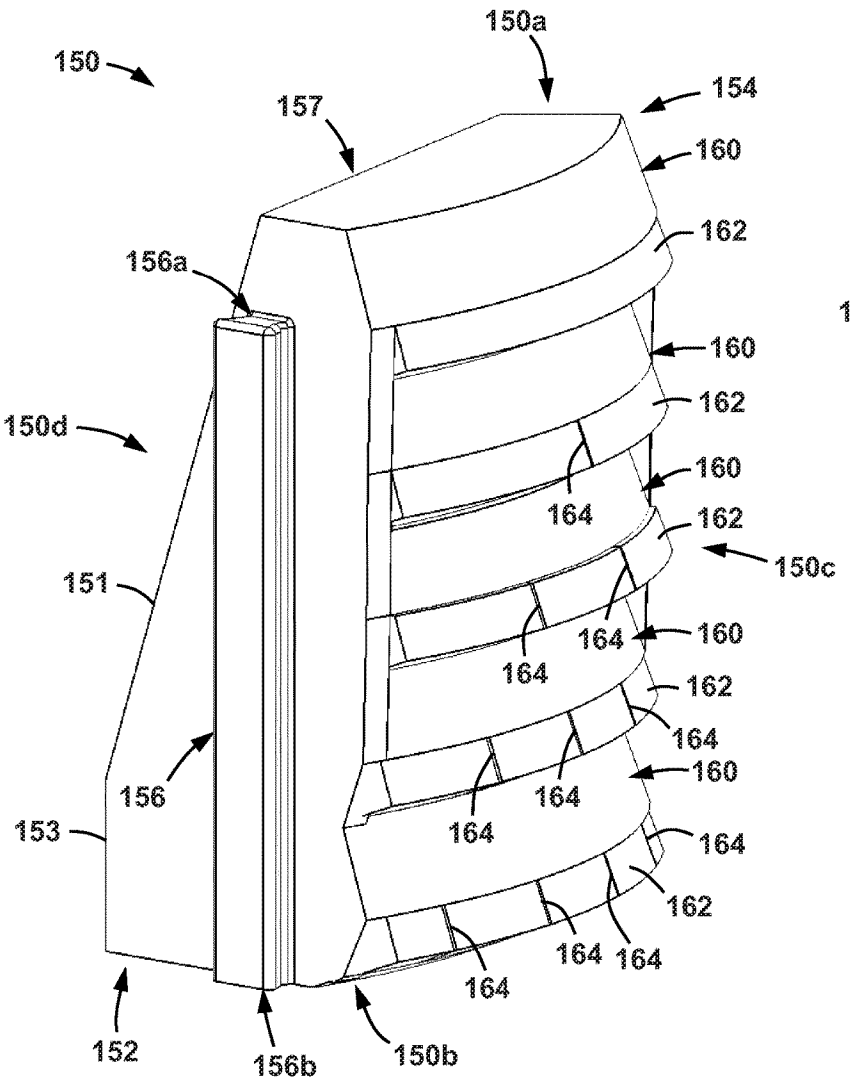

Referring now to FIGS. 2 and 3, slip 100 is a ring-shape member that includes a central or longitudinal axis 105 that is generally aligned with axis 15 of downhole sealing tool 10 during operations (although such alignment is not required). In addition, slip 100 includes a first end 100*a*, a second end 100*b* opposite first end 100*a*, and a throughbore 102 extending axially between ends 100*a*, 100*b*. As best shown in FIG. 3, in this embodiment, throughbore 102 is octagonal in cross-section and tapers radially inward toward axis 105 when moving from first end 100*a* toward second end 100*b*. As will be described in more detail below, only a portion of throughbore 102 is tapered as described above (e.g., the portion constituted by surfaces 151 of segments 150 as described below), and the remaining portion extends axially along axis 105 (e.g., the portion constituted by surfaces 153 of segments 150 as described below). It should be appreciated that the shape of throughbore 102 may be greatly varied in other embodiments, and may be circular, rectangular, hexagonal, elliptical, etc. In at least some embodiments, the shape of throughbore 102 is set to match or correspond with the shape of mandrel 18 on downhole sealing tool 10 (however, such matching or correspondence is not necessarily required). As a result, in this embodiment, mandrel 18 is octagonal in cross-section (see FIG. 1).

As is also shown in FIG. 2, slip 100 also comprises a plurality of individual, discrete slip segments or members 150 that are coupled to one another to form slip 100. Specifically, in this embodiment, slip 100 comprises a total of eight (8) slip segments 150 that are symmetrically disposed about axis 105; however, the specific number of slip segments 150 may be varied in to other embodiments (e.g., the number of slip segments 150 may be more or less than eight in other embodiments). Slip segments 150 will now be described in more detail below.

Referring now to FIGS. 4-7, one of the slip segments 150 is shown, it being appreciated that each slip segment 150 forming slip 100 is substantially the same. Each slip segment 150 comprises a body 157 including first end 150*a* that is coincident with first end 100*a* of slip 100 when slip segment 150 is incorporated therein, and a second end 150*b* that is opposite first end 150*a* and is coincident with second end 100*b* of slip 100 when slip segment 150 is incorporated therein. In addition, slip segment 150 also includes a radially outer side 150*c* and a radially inner side 150*d*. As shown in FIG. 3, radially inner side 150*d* is more proximate axis 105 of slip 100 than radially outer side 150*c* when slip segment 150 is incorporated within slip 100. Further, referring back now to FIGS. 4-7, slip segment 150 includes a first lateral side 152 and a second lateral side 154 opposite first lateral side 152. Each of the lateral sides 152, 154 extend radially with respect to axis 105 between radially outer side 150*c* and radially inner side 150*d* when slip segment 150 is incorporated within slip 100 (see FIGS. 2 and 3).

Radially outer side 150*c* includes a plurality of axially spaced teeth 160 that are configured to engage with inner surface 50*a* of tubular 50 during operations. An arcuate engagement member 162 is mounted to each tooth 160, such that each engagement member 162 forms the leading edge of the corresponding tooth 160. In this embodiment, each engagement member 162 extends arcuately about axis 605 when slip segment 650 is incorporated within slip 600. During radial expansion of slip 100 engagement members 162 engage with radially inner surface 50*a* to thereby fix the position of downhole sealing device 10 within tubular 50 as previously described. Thus, engagement members 162 comprise a suitable material for engaging with inner surface 50*a* during operations. For example, engagement members 162 may comprise 8620 Chrome-Nickel-Molybdenum alloy, carbon steel, tungsten carbide, cast iron, and/or tool steel. In some embodiments, engagement members 162 may comprise a composite material.

Figure 6:
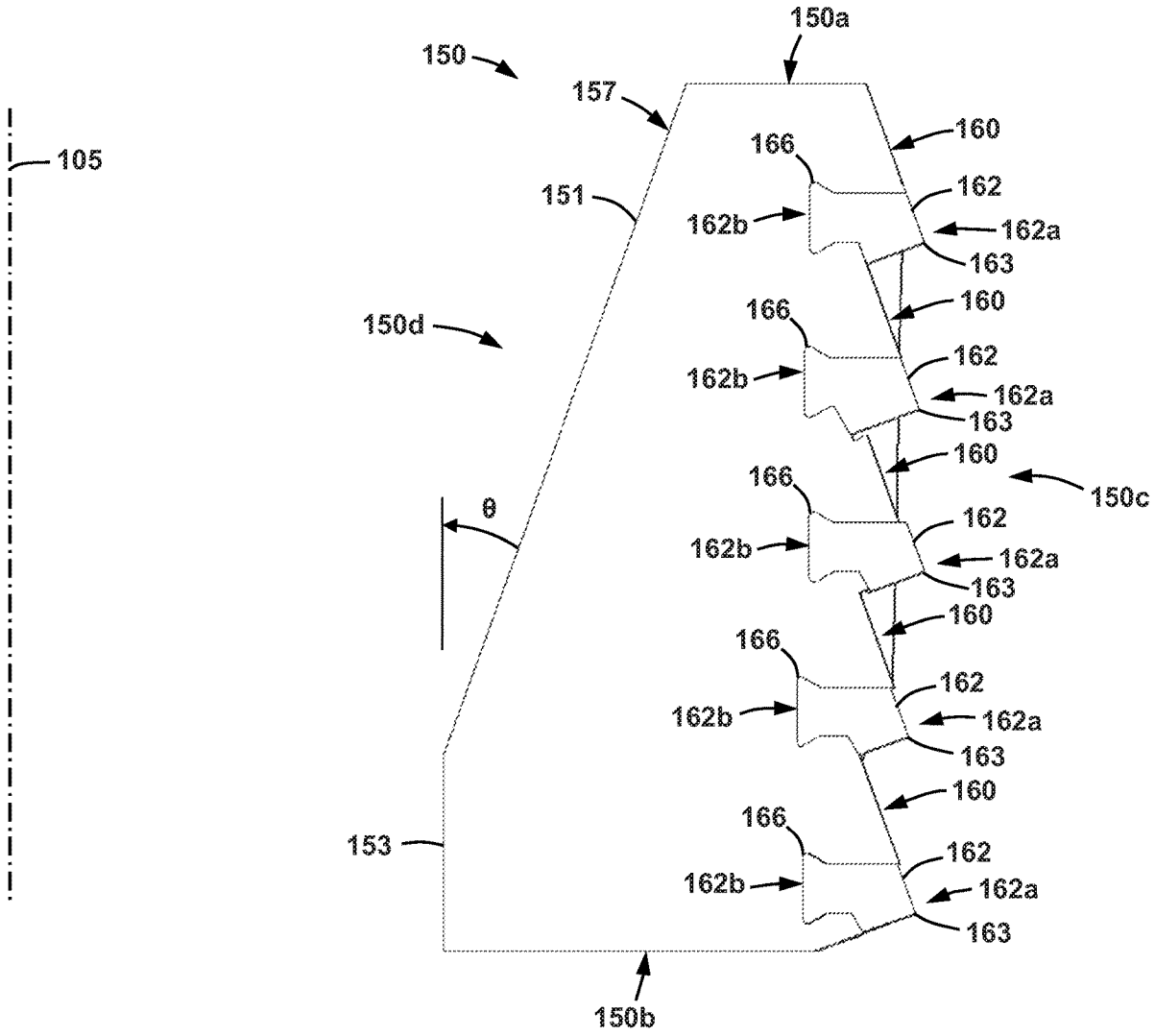
FIG. 6 is a cross-sectional view of the slip segment of FIGS. 4 and 5.

Referring now to FIG. 6, each engagement member 162 is embedded within the body 157 of slip segment 150. As shown, in this embodiment, each engagement member 162 includes a radially outer end 162*a*, and a radially inner end 162*b* opposite radially inner end 162*a*. Radially inner end 162*b* is more proximate to radially outer end 162*a* when engagement members 162 are embedded within the body 157 of one of the slip segments 150 and the slip segment 150 is incorporated within slip 100 (see FIGS. 2 and 3) (Note: axis 105 of slip 100 is shown in FIG. 6 to show the relative position of axis and the featured components of slip segment 150 as a matter of convenience). Thus, radially outer end 162*a* includes a leading edge or tip 163 that engages with inner surface 50*a* of tubular 50 when slip 100 is radially expanded during operations. Radially inner end 162*b* includes a dovetail engagement feature or profile 166 that increases the surface area contact between radially inner end 162*b* of engagement member 162 and the body 157 of slip segment 150. Engagement feature 166 may be formed into a variety of other shapes other than dovetail such as, for example, rectangular, circular, semi-circular, rhomboid, etc. In some embodiments, at least a portion of each engagement member 162 is molded or cast within the body 157 of slip segment 150. Particularly, in certain embodiments, the engagement feature 166 of each engagement member 162 is molded or cast within the body 157 of slip segment 150.

Referring again to FIGS. 4 and 5, at least some (but not necessarily all) of the engagement members 162 include one or more slits or grooves 164 extending therein. During operations, when it is desirable to remove downhole sealing device 10 from tubular 50, a mill or other drilling device (e.g., drill bit) is inserted within tubular 50 and engaged with downhole sealing device 10 to breakup and remove the same, thereby once again forming an open flow path through tubular 50. During this process, it is typically advantageous to design downhole sealing device 10 so that it breaks apart into several small pieces that are more easily removed from tubular 50 and that are less likely to create a flow blockage therein. Thus, without being limited to this or any other theory, slits or grooves 164 in engagement members 162 facilitate breakup of engagement members 162 into relatively small pieces during the milling process described above. It should be appreciated that engagement members 162 may include zero (0), one (1), two (2), three (3), four (4) or more slits or grooves 164 therein in some embodiments.

In at least some embodiments, engagement members 162 may be formed by cutting a plurality of rings out of a sheet of material (e.g., any one or more of the materials discussed above for forming engagement members 162). Thereafter, the rings may then be cut into a plurality of arcuate segments, with the number and size of the arcuate segments being determined based on the desired number and arrangement of engagement members 162 on slip 100. Finally, if notches or grooves 164 are desired, they are then cut into the arcuate segments in the desired size and arrangement.

Figure 7:
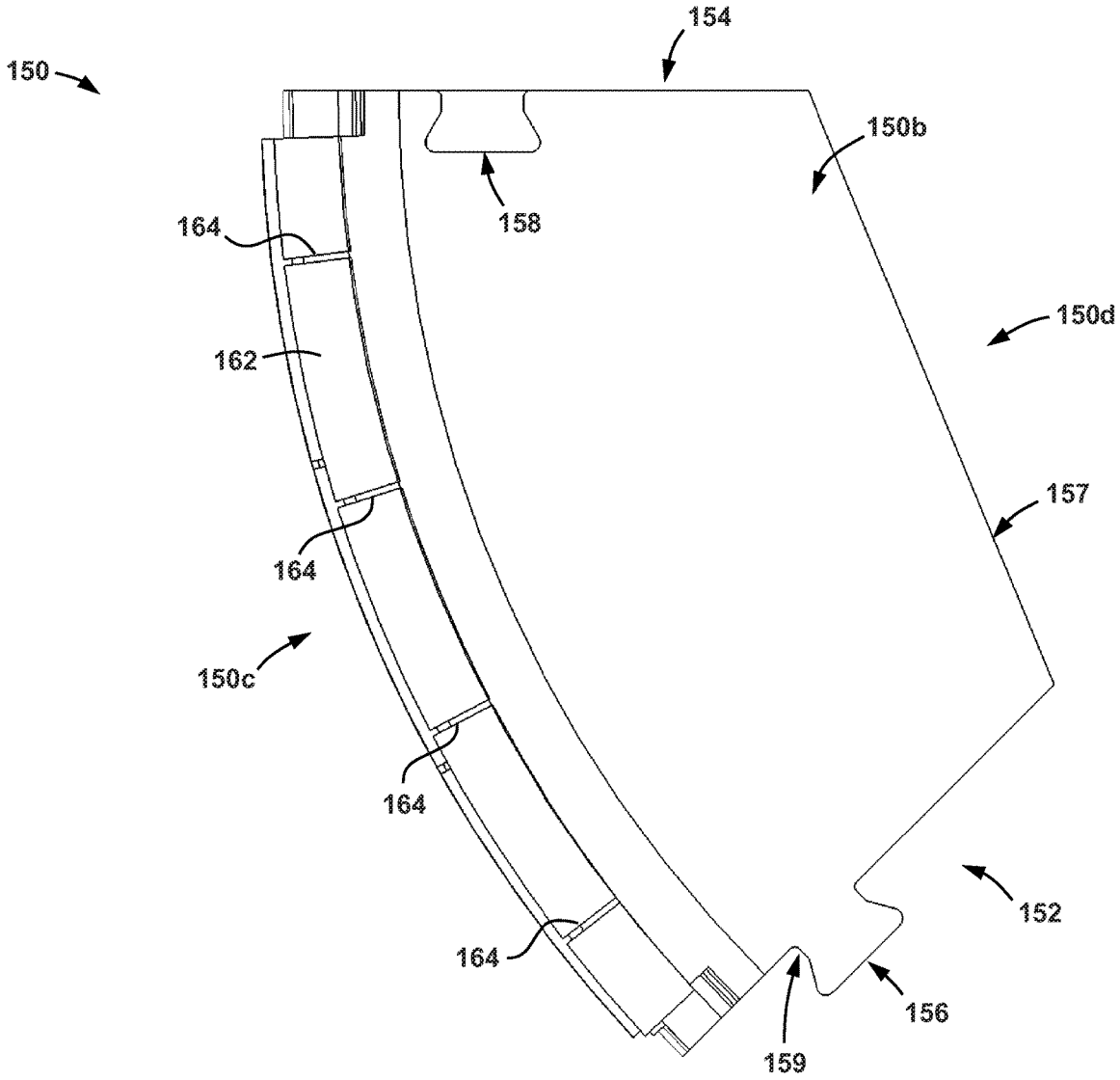
FIG. 7 is a bottom view of the slip segment of FIGS. 4 and 5.

Referring again to FIGS. 4-7, first lateral side 152 of body 157 of slip segment 150 includes an axially extending tenon or projection 156 that includes a first end 156*a* and a second end 156*b* opposite first end 156*a*. Second end 156*b* is coincident with second end 150*b* of slip segment 150 and first end 156*a* is axially spaced from first end 150*a* of slip segment 150 with respect to axis 105 (see FIGS. 2, 4, and 5). As is best shown in FIG. 7, in this embodiment, projection 156 is formed in a dovetail shape and thus includes a throat or minimum thickness region 159. Referring again to FIGS. 4-7, second lateral side 154 of slip segment 150 includes an axially extending mortise or slot 158 that includes a first end 158*a*, and a second end 158*b* opposite first end 158*a*. Second end 158*b* is coincident with second end 150*b* of slip segment 150 and first end 158*a* is axially spaced from first end 150*a* of slip segment 150. As is best shown in FIG. 7, slot 158 is shaped so as to correspond to projection 156 (i.e., the shape of slot 158 matches the shape of projection 156). Thus, in this embodiment, slot 158 is also formed in a dovetail shape that is sized to slidingly receive the projection 156 of another of the slip segments 150 during makeup of slip 100.

As is shown in FIG. 6, radially inner side 150*d* of body 157 includes a first planar surface 151 extending from first end 150*a*, and a second planar surface 153 extending axially between first planar surface 151 and second end 150*b*. When slip segment 150 is incorporated within slip 100, first planar surface 151 extends at an angle θ relative to axis 105, and second planar surface 153 extends generally parallel to axis 105. The angle θ may range between 0° and 90°, and in some embodiments ranges from 10° and 25°, and in still other embodiments ranges from 19° to 20°.

In this embodiment, the material making up body 157 of slip segment 150 is a single monolithic piece (i.e., all portions of slip segment 150 other than engagement members 162 are formed of a single, integrated body of material). For example, in some embodiments, body 157 may be molded or cast from a single molten, liquid, or semi-liquid material which is then allowed to harden or solidify to form body 157. As another example, in some embodiments, body 157 may be die casted, where a molten material is injected to in a mold under pressure. In some embodiments, the die casting process used to produce body 157 is an exothermic process (i.e., where no external heat is supplied to the mold other than that supplied by the molten material itself). Body 157 may be formed from any suitable material, such as, for example, metal, polymer, composite, etc. In this embodiment, body 157 comprises zinc or a zinc alloy that is cast into a mold also containing the engagement members 162 positioned therein. However, in other embodiments, body 157 may comprise aluminum, magnesium, and alloys thereof. In at least some embodiments, the material forming engagement members 162 is harder than the material forming body 157.

Figure 8:
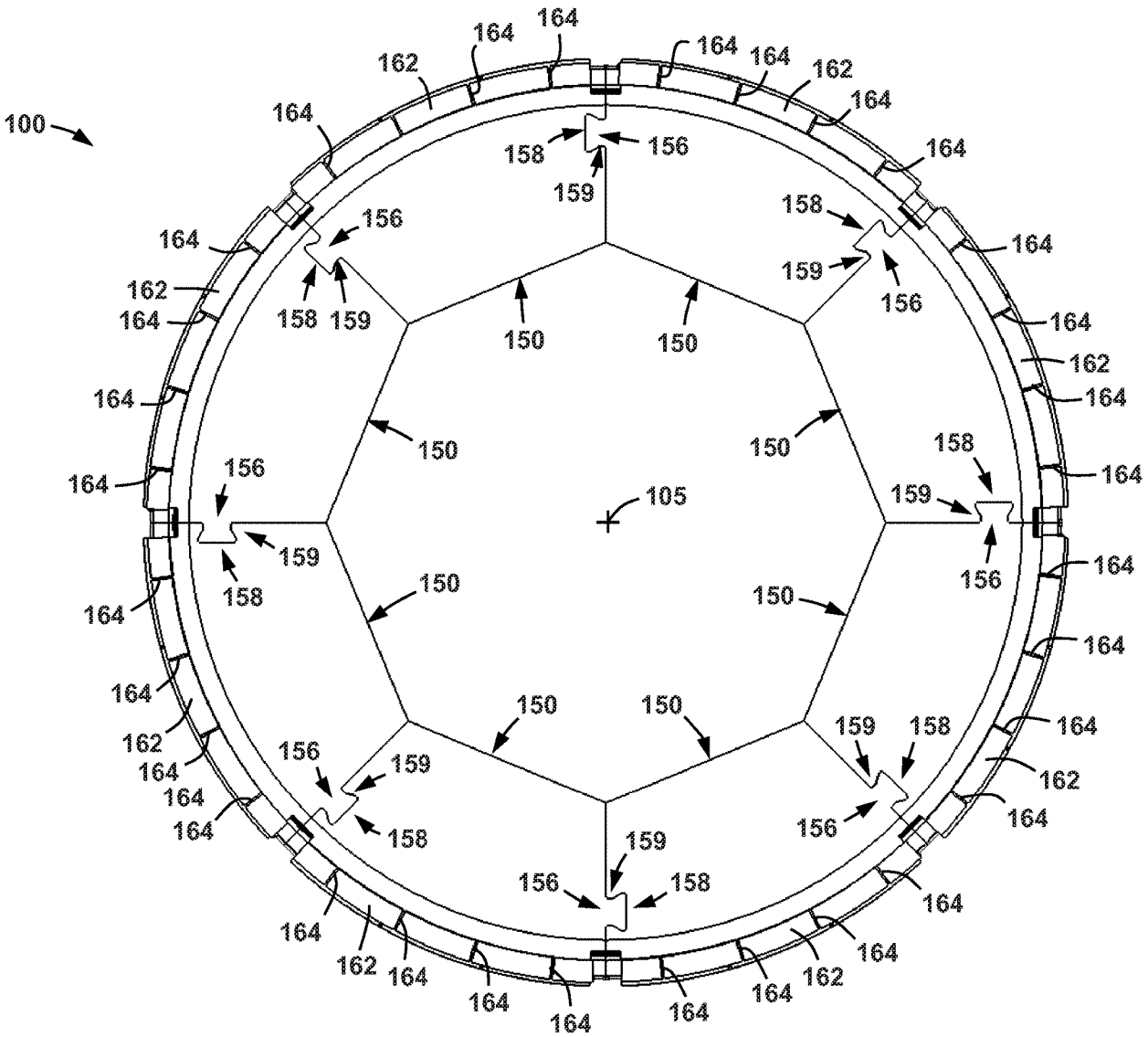
FIG. 8 is a bottom view of the slip of FIG. 2.

Referring now to FIGS. 2, 3, and 8, during assembly of slip 100, each of the slip segments 150 are symmetrically arranged and coupled to one another to form slip 100. In particular, each slip segment 150 is coupled to an angularly adjacent slip segment 150 about axis 105 by inserting the projections 156 of one of the segments 150 axially within the corresponding slot 158 of the adjacent segment 150 until the first end 156*a* of the projections engages or abuts the upper end 158*a* of the slot 158. In some embodiments, an adhesive is applied to either projections 156 or the corresponding slots 158 to secure projections 156 therein. Each additional slip segment 150 is then coupled to the immediately angularly adjacent slip segment 150 in the same fashion until slip 100 is fully formed as shown. Thus, when slip 100 is fully formed, the radially outer sides 150*c* of slip segments 150 form the radially outer most surface of slip 100, and the radially inner sides 150*d* of slip segments form throughbore 102. Specifically, the first planar surfaces 151 on radially inner sides 150*d* of slip segments 150 together form a tapering portion within throughbore 102 that extends axially from first end 100*a* and tapers radially inward toward axis 105, and second planar surfaces 153 together form an axially extending portion within throughbore 102 that extends axially from surfaces 151 to second end 100*b*.

Referring now to FIGS. 1, 2 and 8, during operations, when mandrel 18 is extended axially within throughbore 102 along axis 15 to expand slip 100 as previously described above, slip 100 is fractured at one or more points to facilitate the radial expansion thereof. In particular, during operations, mandrel 18 is actuated axially in the manner previously described above such that the radially outer surface of mandrel 18 slidingly engages with first planar surfaces 151 within throughbore 102. As previously described, the radially outer surface of mandrel 18 is shaped to correspond with the shape of throughbore 102 so as to increase the surface area contact between mandrel 18 throughbore 102 (particularly surfaces 151) and mandrel 18 during these operations. As mandrel 18 advances axially within throughbore 102 the sliding engagement between the tapered surfaces of both mandrel 18 and first surfaces 151 impart a radially expansive force onto slip 100 which eventually causes slip 100 to fracture at one or more points and thereafter radially expand to engage with inner surface 50*a* in the manner described above. Due to the minimum thickness region 159 on each of the projections 156 (see FIG. 8), segments 150 are configured to fracture and separate from one another at the joint or coupling between the interlocking projections 156 and slots 158. Therefore, it is possible to design or set the fracturing force or pressure by adjusting the thickness of regions 159 on projections 156.

Figure 9:
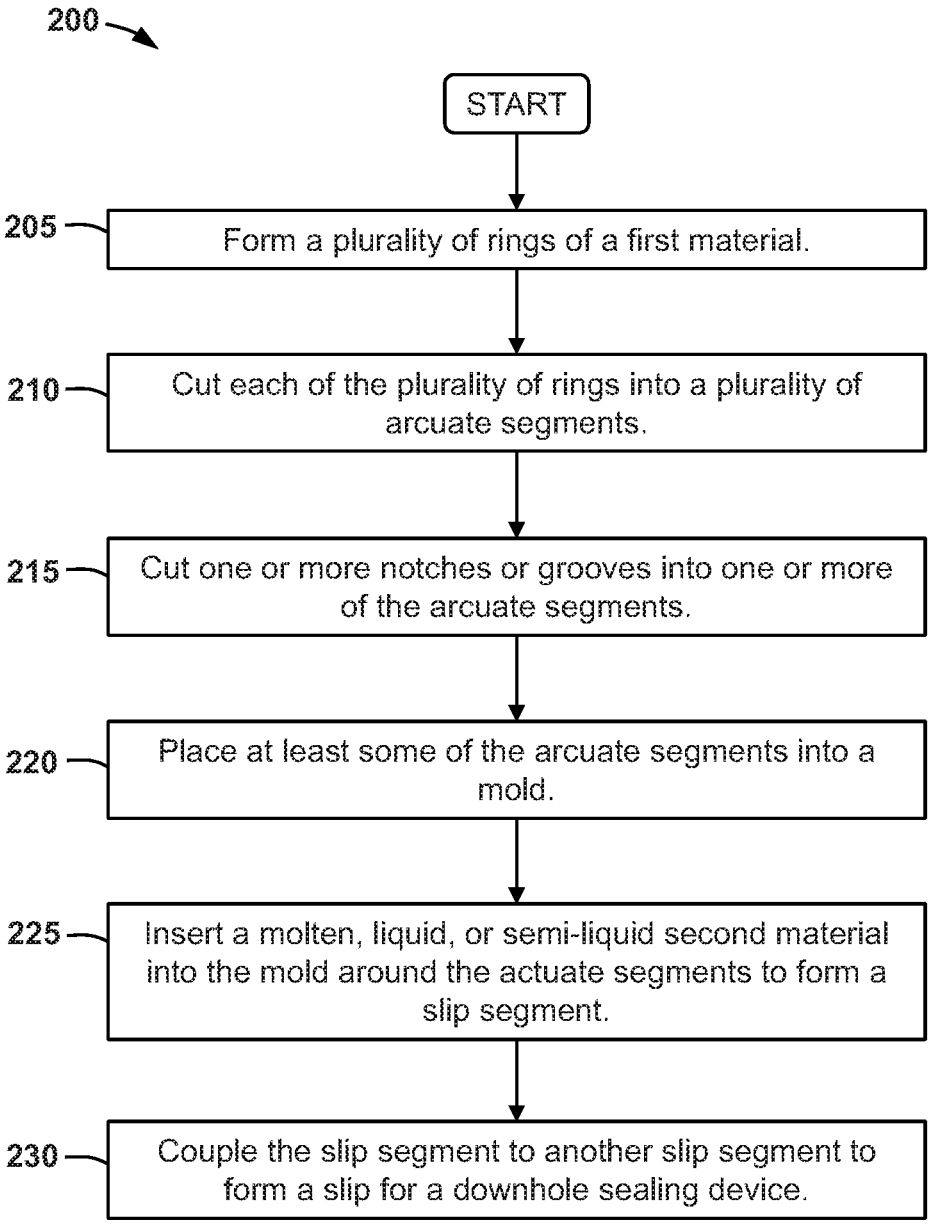
FIG. 9 is a diagram of a method for manufacturing a slip for a downhole sealing device in accordance with at least some embodiments.

Referring now to FIG. 9, a method 200 for forming, producing, or manufacturing a slip (e.g., slip 100) for a downhole sealing device (e.g., device 10) is shown. In explaining the steps of method 200, reference will be made to the slip 100 shown in FIGS. 1-8; however, it should be appreciated that method 200 may be performed to form, produce, or manufacture another slip (i.e., other than slip 100). Thus references to slip 100 are made as a matter of convenience.

Initially, method 200 includes forming a plurality of rings of a first material at 205. The first material may be any suitable material for forming a structural component of a slip. For example, the first material may be a material suitable for forming a hard component for cutting or engaging with the inner surface (e.g., surface 50*a*) of a downhole tubular (e.g., tubular 50). As a result, in some embodiments, the first material may comprise a metal alloy (e.g., 86-20 Chrome-Nickel-Molybdenum alloy, carbon steel, tungsten carbide, cast iron, and/or tool steel. In other embodiments, the first material may comprise composite.

Next, each of the plurality of rings of the first material are cut into a plurality of arcuate segments at 210. The number and size of the arcuate segments in 210 is determined by a variety of factors, such as, for example, the number of slip segments (e.g., slip segments 150) to be included in the slip (e.g., slip 100), the size (e.g., diameter) of the slip, etc. For the embodiment of FIGS. 1-8, the arcuate segments at 210 correspond with the engagement members 162.

After the plurality of arcuate segments (e.g., engagement members 162) are formed at 210, one or more notches or grooves (e.g., grooves 164) are cut into one or more of the arcuate segments at 215. In some embodiments, one or more notches or grooves are cut into only one of the arcuate segments at 215, in other embodiments, one or more notches or grooves are cut into more than one but not all of the arcuate segments at 215, and in still other embodiments, one or more notches or grooves are cut into all of the arcuate segments at 215. Moreover, it should be appreciated that in some embodiments, no grooves or notches are cut into any of the arcuate segments at 215.

At 220, at least some of the arcuate segments (e.g., engagement members 162) are installed within a mold or cast. The mold in 220 includes a cavity that substantially conforms to the shape of a slip segment (e.g., slip segment 150) of a slip (e.g., slip 100). Thus, when employing method 200 to manufacture the slip 100 shown in FIG. 1-8, the mold in 220 includes a cavity that includes the sides 150*c*, 150*d*, 152, 154 (and their associate surfaces) as described above. Moreover, in these embodiments, the cavity in mold 220 also includes appropriate projections and recesses to form teeth 160 (with the exception of engagement members 162 which are formed by the arcuate segments placed within the mold), projection 156 on first lateral side 152, and slot 158 on second lateral side 154 (see FIG. 4-7).

Next, method 200 includes inserting (e.g., pouring, injecting, etc.) a molten, liquid, or semi-liquid second material into the mold at 225 after placing the arcuate segments therein at 220 to form a slip segment (e.g., slip segment 150). In some embodiments, the second material may be different from the first material forming arcuate segments. Second material may be any suitable material for making up a structural component of a slip (e.g., slip 100). In some embodiments, second material may comprise a lower cost material to reduce the overall costs for the resulting slip. In the embodiment of FIGS. 1-8, the second material (i.e., the material forming all portions of slip segment 150 except for engagement members 162) comprises zinc or a zinc alloy. However, in other embodiments, the second material may comprise aluminum, magnesium, and alloys thereof. In still other embodiments, the second material may comprise composite or plastic.

Finally, after the molten, liquid, or semi-liquid second material inserted within the mold at 225 has solidified (thereby securing the arcuate segments therein), the slip segment (e.g., slip segment 150) is removed from the mold in 230 and may then be coupled to at least one other slip segment that is similarly formed (e.g., formed by the same or similar steps as 205-225) at 230 to form a slip (e.g., slip 100) for a downhole sealing device (e.g., device 10). In some embodiments, the slip segment formed at 205-225 is coupled to another similar slip segment by engaging a projection (e.g., projection 156) on one of the slip segments with a corresponding slot (e.g., slot 158) on the other of the slip segments; however, other coupling methods may be used in other embodiments.

Figure 10:
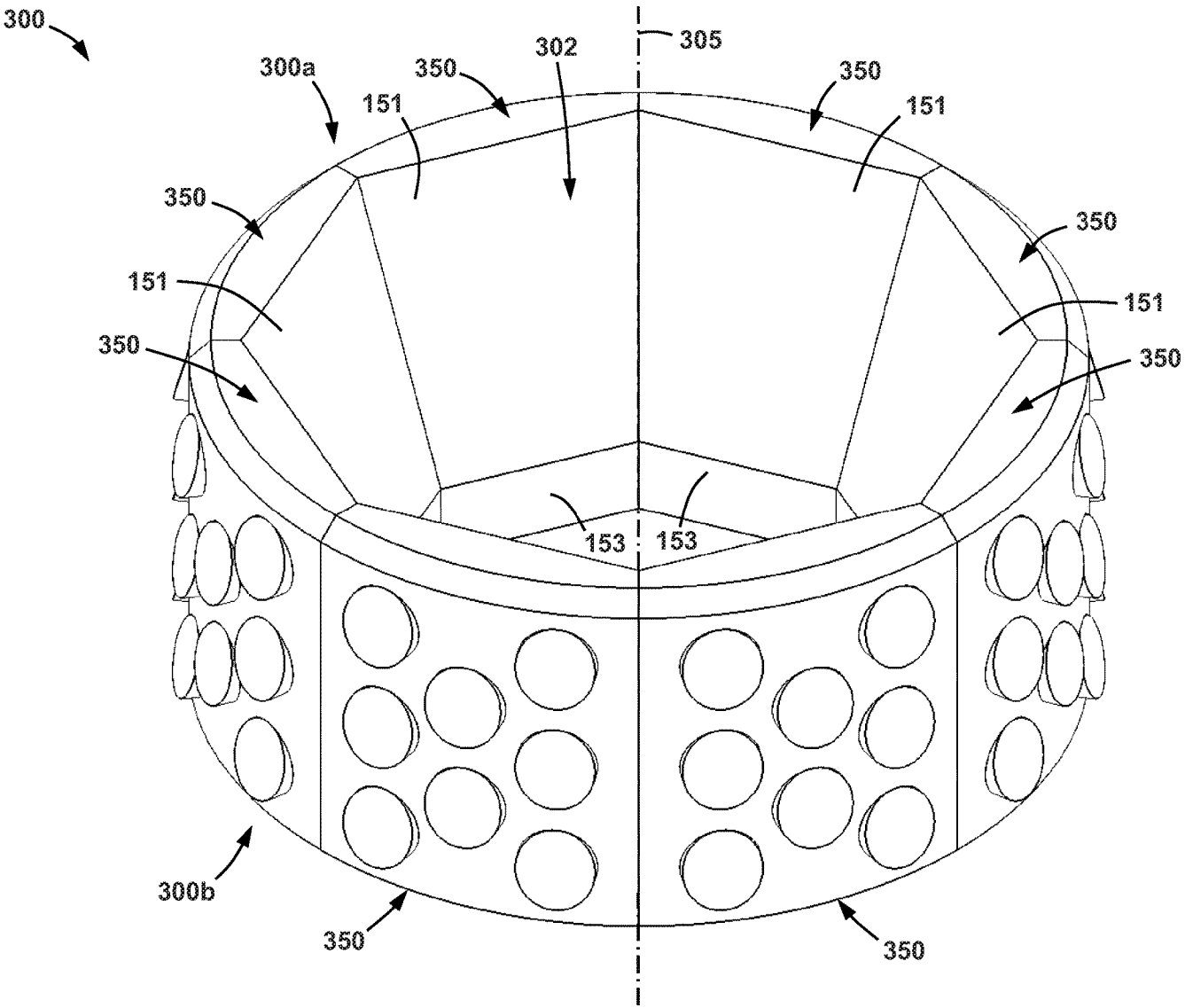
FIG. 10 is a perspective view of another slip for use with the downhole sealing device of FIG. 1 in accordance with at least some embodiments disclosed herein.
Figure 11:
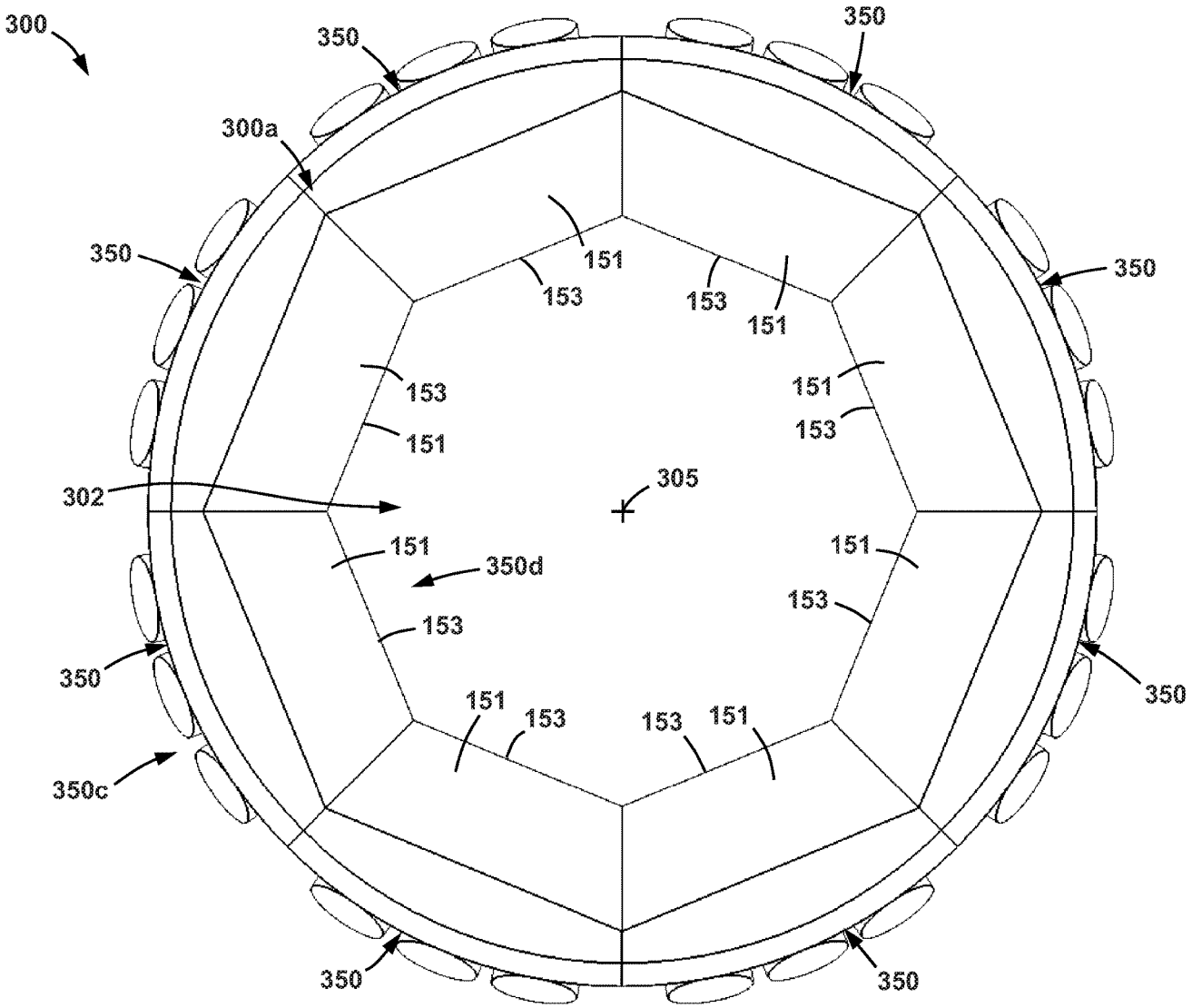
FIG. 11 is a top view of the slip of FIG. 10.

Referring now to FIGS. 10 and 11, another embodiment of a slip 300 for use with downhole sealing device 10 in place of slip 100 is shown. Slip 300 is generally similar to slip 100, previously described, and thus, components that are shared among slips 100, 300 are referred to with the same reference numerals, and the description below will focus on the components and features of slip 300 that are different from slip 100.

Slip 300 is a ring-shape member that includes a central or longitudinal axis 305 that is generally aligned with axis 15 of downhole sealing tool 10 during operations (although such alignment is not required). In addition, slip 300 includes a first end 300*a*, a second end 300*b* opposite first end 300*a*, and a throughbore 302 extending axially between ends 300*a*, 300*b*. In this embodiment, throughbore 302 is substantially the same as throughbore 102 on slip 100, and thus, a detailed description of throughbore 302 is omitted herein in the interests of brevity.

As with slip 100 slip 300 comprises a plurality of individual, discrete slip segments or members 350 that are coupled to one another to form slip 300. Specifically, in this embodiment, slip 300 comprises a total of eight (8) slip segments 350 that are symmetrically disposed about axis 305; however, the specific number of slip segments 350 may be varied in to other embodiments (e.g., the number of slip segments 350 may be more or less than eight in other embodiments). Slip segments 350 will now be described in more detail below.

Figure 13:
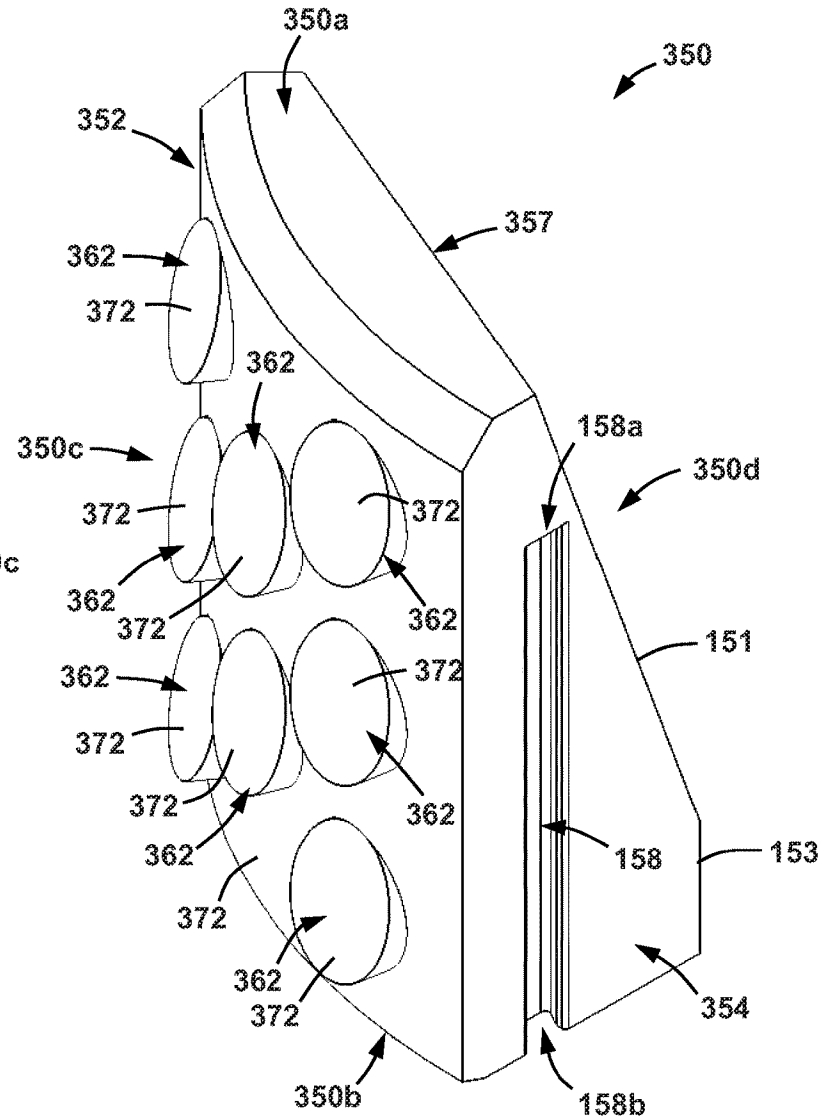
FIGS. 12 and 13 are perspective views of one of the slip segments of the slip of FIG. 10.
Figure 12:
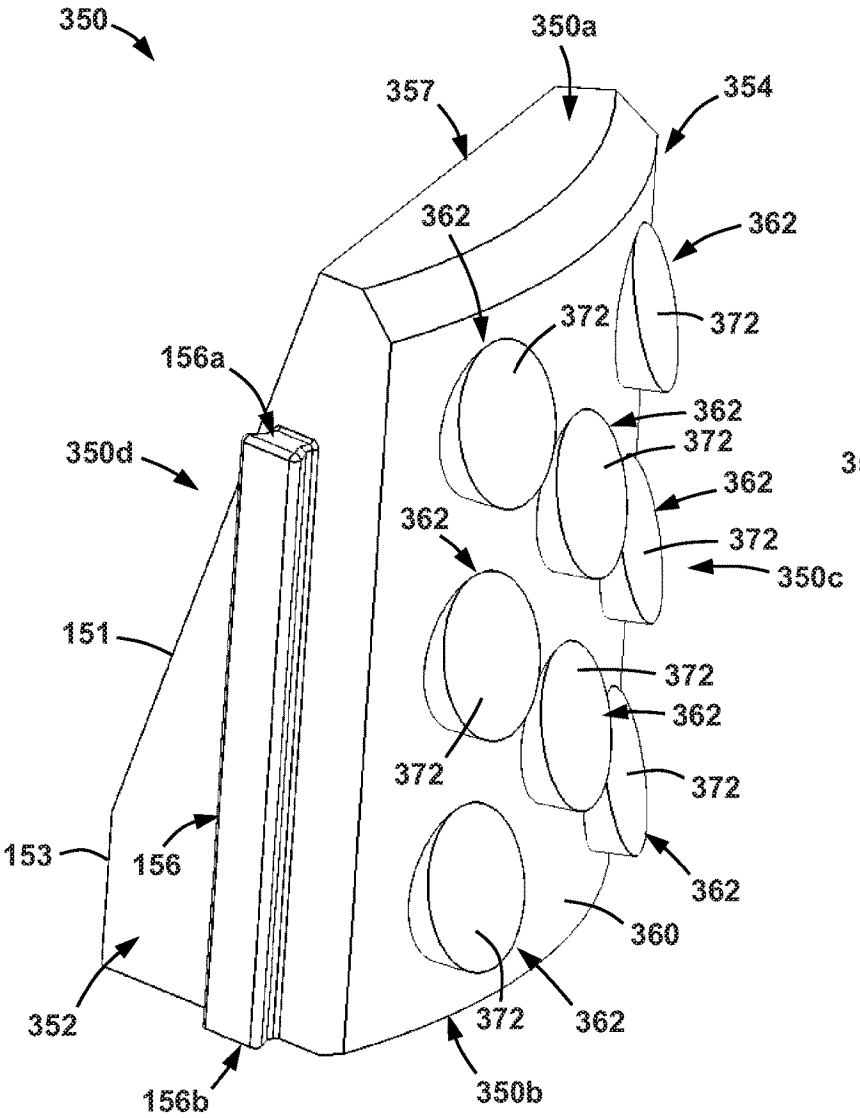

Referring now to FIGS. 12 and 13, one of the slip segments 350 is shown, it being appreciated that each slip segment 350 forming slip 300 is substantially the same. Each slip segment 350 comprises a body 357 including first end 350*a* that is coincident with first end 300*a* of slip 300 when slip segment 350 is incorporated therein, and a second end 350*b* that is opposite first end 350*a* and is coincident with second end 300*b* of slip 300 when slip segment 350 is incorporated therein. In addition, slip segment 350 also includes a radially outer side 350*c* and a radially inner side 350*d*. As shown in FIG. 11, radially inner side 350*d* is more proximate axis 305 of slip 300 than radially outer side 350*c* when slip segment 350 is incorporated within slip 300. Further, referring back now to FIGS. 12 and 13, slip segment 350 includes a first lateral side 352 and a second lateral side 354 opposite first lateral side 352. Each of the lateral sides 352, 354 extend radially with respect to axis 305 between radially outer side 350*c* and radially inner side 350*d* when slip segment 350 is incorporated within slip 300 (see FIGS. 10 and 11).

Radially outer side 350*c* includes an arcuate outer surface 360 and a plurality of engagement members 362 mounted to surface 360. In this embodiment outer surface 360 extends cylindrically about axis 305 between lateral sides 352, 354. In other embodiments, arcuate outer surface 360 is replaced with a substantially planar surface. Each of the engagement members 362 is embedded in body 357 and extends radially beyond outer surface 360 such that during radial expansion of slip 300, engagement members 362 engage with radially inner surface 50*a* of tubular 50 to thereby fix the position of downhole sealing device 10 within tubular 50 as previously described. Thus, engagement members 362 comprise a suitable material for engaging with inner surface 50*a*, and potentially digging into (at least partially) inner surface 50*a* during operations. For example, engagement members 362 may comprise 86-20 Chrome-Nickel-Molybdenum alloy, carbon steel, tungsten carbide, cast iron, and/or tool steel.

Figure 14:
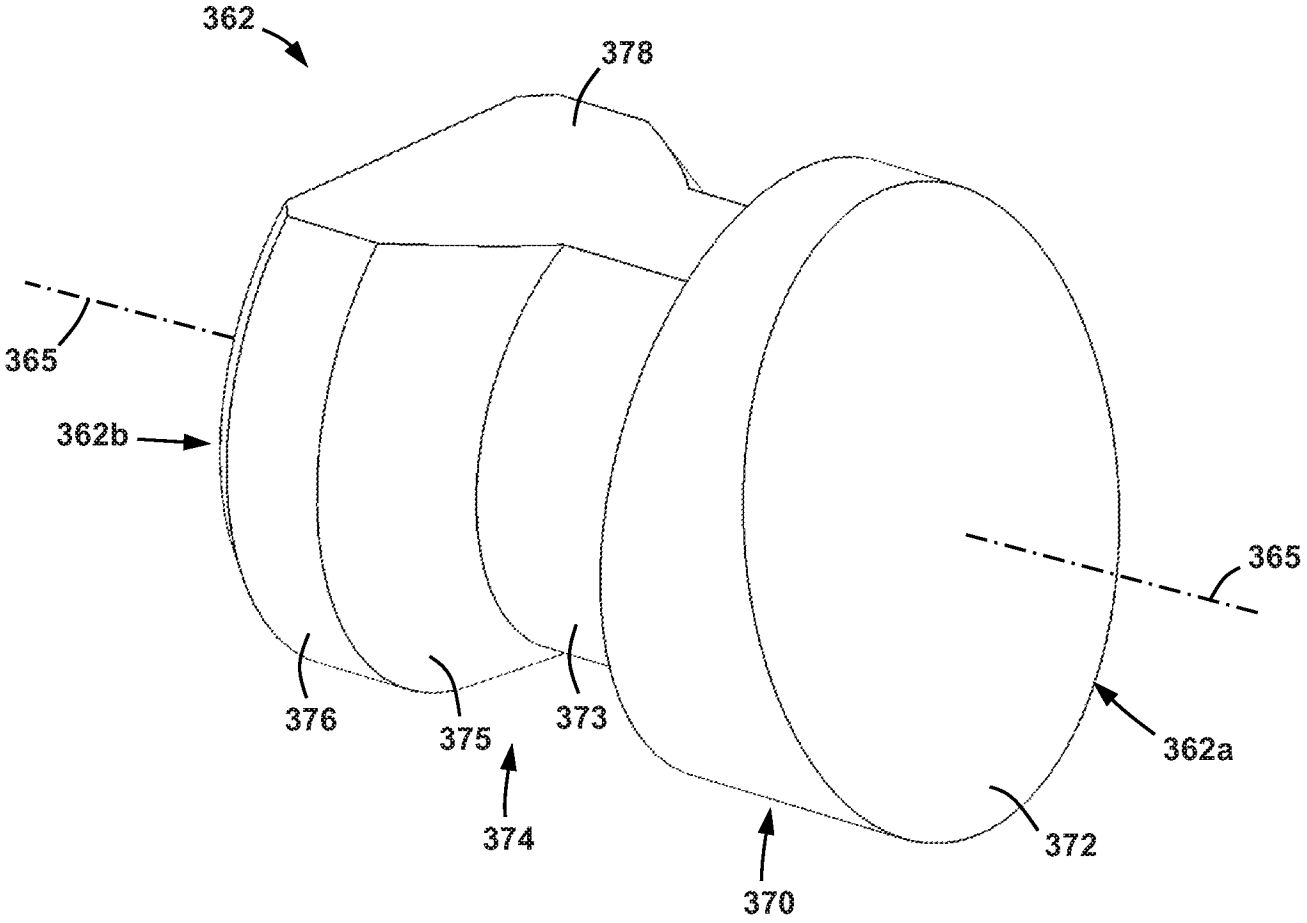
FIG. 14 is a perspective view of one of the engagement members mounted to the slip segment of FIGS. 12 and 13.
Figure 15:
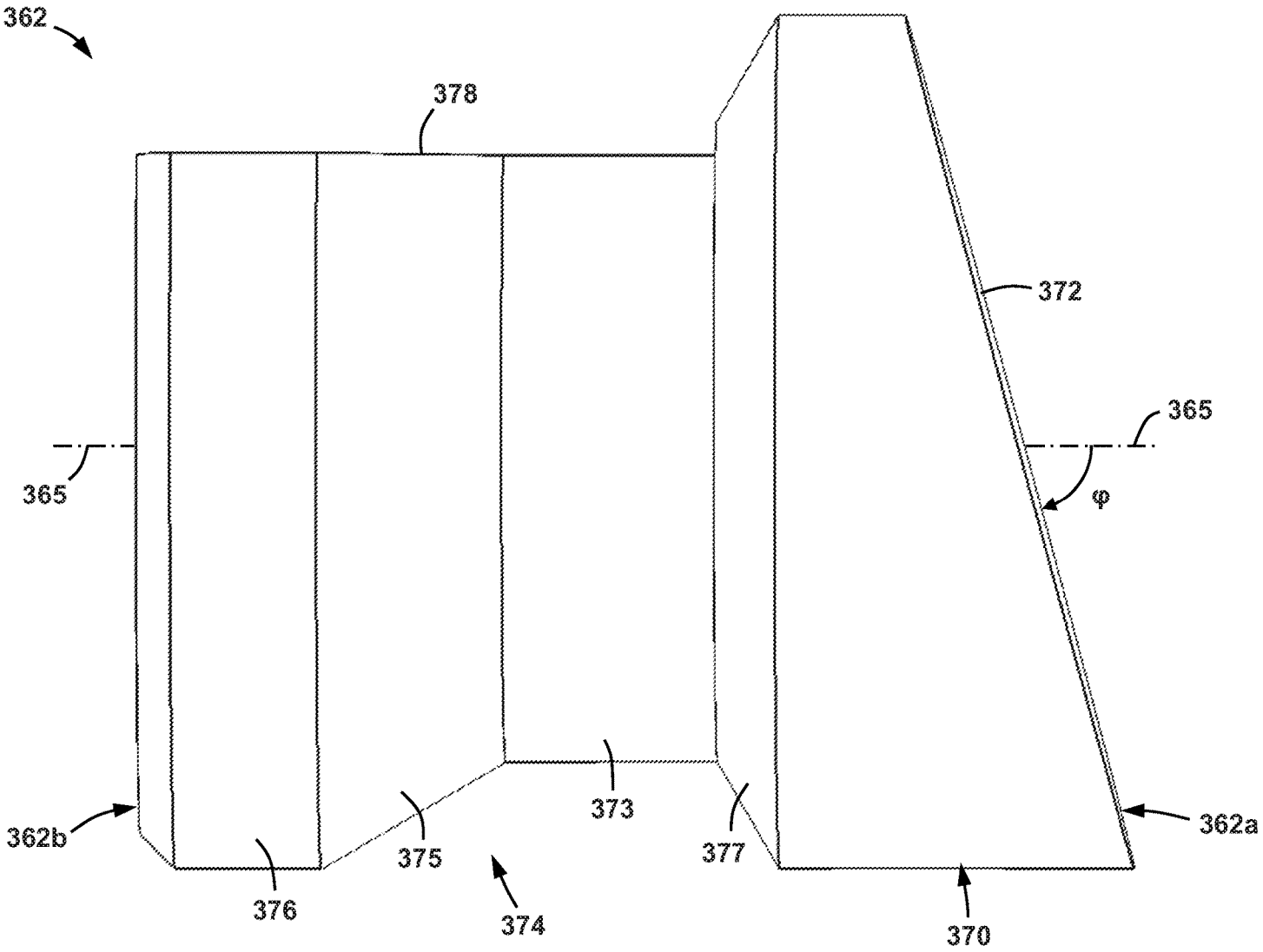
FIG. 15 is a side view of the engagement member of FIG. 14.

Referring now to FIGS. 14 and 15, one of the engagement members 362 is shown, it being understood that each engagement member 362 is configured the same. Engagement member 362 includes a central axis 365, a first or radially outer end 362*a*, and a second or radially inner end 362*b* opposite radially outer end 362*a*. In some embodiments, axis 365 extends radially with respect to axis 305 of slip 300 (although such alignment is not required). In addition, as shown in FIGS. 14 and 15, engagement member 362 includes a cylindrical head 370 at radially outer end 362*a*, a base 374 extending axially from head 370 to radially inner end 362*b*.

Head 370 includes a planar engagement surface 372 that extends at an angle φ with respect to axis 362, that is less than 90°, and preferably ranges from 45° to 85°. During radial expansion of slip 300, planar engagement surface 372 is engaged with inner surface 50*a* of tubular 50 as described above.

Base 374 is shaped to maximize engagement with body 357 when engagement member 362 is embedded therein. Specifically, in this embodiment base 374 includes a first cylindrical surface 376 axially proximate radially inner end 362*b* and a second cylindrical surface 373 axially disposed between head 370 and first cylindrical surface 376. Second cylindrical surface 373 has a diameter that is smaller than both the diameters of the first cylindrical surface 376 and head 370. As a result, a first frustoconical surface 375 extends axially between first cylindrical surface 376 and second cylindrical surface 373, and a second frustoconical surface 377 extends axially between second cylindrical surface 373 and head 370. In addition, base 374 includes a planar surface 378 extending axially from radially inner end 362*b* to second frustoconical surface 377. As a result, planar surface 378 extends through each of the first cylindrical surface 376, the first frustoconical surface 375, and the second cylindrical surface 373. Without being limited to this or any other theory, when engagement member 362 is embedded within body 357, the engagement between body 357 and planar surface 378 prevents relative rotation of engagement member 362 and body 357 about axis 365. As a result, planar surface 378 of base 374 helps to maintain the desired rotational orientation of engagement member 362 about axis 365 relative to body 357. Engagement members 362 may be formed by machining (e.g., milling, grinding, cutting, etc.), casting, sintering, etc.

During manufacturing of slip segment 350, engagement members 362 are embedded within the body 357 of slip segment 350 such that a portion of head 370 (and particularly planar engagement surface 372 extends radially beyond arcuate surface 360. The remaining portion of head 370 and base 374 of each engagement member 362 are all disposed and embedded within body 357 such that engagement member 362 is substantially secured to body 357 during operations.

Referring again to FIGS. 12 and 13, as with slip segment 150, first lateral side 352 of body 357 of slip segment 350 includes the axially extending projection 156 and second lateral side 354 of body 357 of slip segment 350 includes the axially extending slot 158. Projection 156 and slot 158 are substantially the same as previously described above. In addition, as is also described for slip segment 150, radially inner side 350*d* of body 357 of slip segment 350 includes the first planar surface 151 extending from first end 350*a*, and the second planar surface 153 extending axially between first planar surface 151 and second end 350*b*. Surfaces 151, 153 are substantially the same as previously described above.

In this embodiment, the material making up body 357 of slip segment 350 is a single monolithic piece (i.e., all portions of slip segment 350 other than engagement members 362 are formed of a single, integrated body of material). For example, in some embodiments, body 357 may be molded or cast from a single liquid or semi-liquid material which is then allowed to harden or solidify to form body 357. Body 357 may be formed from any suitable material, such as, for example, metal, polymer, composite, etc. In this embodiment, body 357 comprises zinc or a zinc alloy that is cast into a mold also containing the engagement members 362 positioned therein. However, in other embodiments, body 357 may comprise aluminum, magnesium, and alloys thereof. In at least some embodiments, the material forming engagement members 362 is harder than the material forming body 357.

Figure 16:
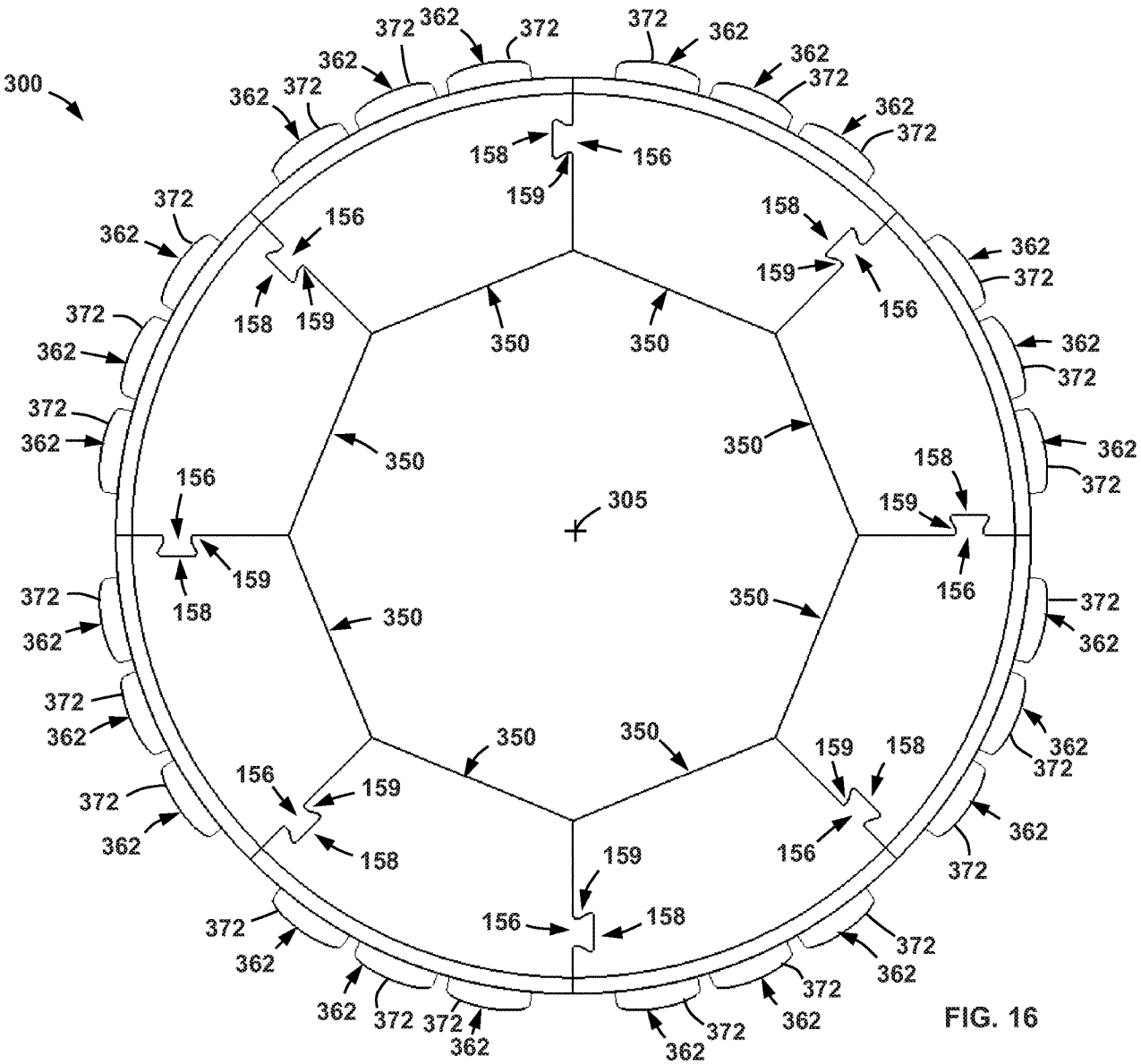
FIG. 16 is a bottom view of the slip of FIG. 10.

Referring now to FIGS. 10, 11, and 16, during assembly of slip 300, each of the slip segments 350 are symmetrically arranged and coupled to one another to form slip 300. In particular, each slip segment 350 is coupled to an angularly adjacent slip segment 350 about axis 305 by inserting the projections 156 of one of the segments 350 axially within the corresponding slot 158 of the adjacent segment 350 in the same manner as previously described above for slip 100. Each additional slip segment 350 is then coupled to the immediately angularly adjacent slip segment 350 in the same fashion until slip 300 is fully formed as shown. Thus, when slip 300 is fully formed, the radially outer sides 350*c* of slip segments 350 form the radially outer most surface of slip 300, and the radially inner sides 350*d* of slip segments 350 form throughbore 302. Specifically, the first planar surfaces 151 on radially inner sides 350*d* of slip segments 350 together form a tapering portion within throughbore 302 that extends axially from first end 300*a* and tapers radially inward toward axis 305, and second planar surfaces 153 together form an axially extending portion within throughbore 302 that extends axially from surfaces 151 to second end 300*b*.

Referring now to FIGS. 1, 10, and 16, during operations, when mandrel 18 is extended axially within throughbore 302 along axis 15 to expand slip 300 as previously described above, slip 300 is fractured at one or more points to facilitate the radial expansion thereof. In particular, during operations, mandrel 18 is actuated axially in the manner previously described above such that the radially outer surface of mandrel 18 slidingly engages with first planar surfaces 151 within throughbore 302. The radially outer surface of mandrel 18 is shaped to correspond with the shape of throughbore 302, in the manner previously described, so as to increase the surface area contact between throughbore 302 (particularly surfaces 151) and mandrel 18 during these operations. As mandrel 18 advances axially within throughbore 302 the sliding engagement between the tapered surfaces of mandrel 18 and first surfaces 151 impart a radially expansive force onto slip 300 which eventually causes slip 300 to fracture at one or more points and thereafter radially expand to engage with inner surface 50*a* in the manner described above. Due to the minimum thickness region 159 on each of the projections 156 (see FIG. 11), slip segments 350 are configured to fracture and separate from one another at the joint or coupling between the interlocking projections 156 and slots 158. Therefore as previously mentioned above for slip 100, it is possible to design or set the fracturing force or pressure for slip 300 by adjusting the thickness of regions 159 on projections 156.

Figure 17:
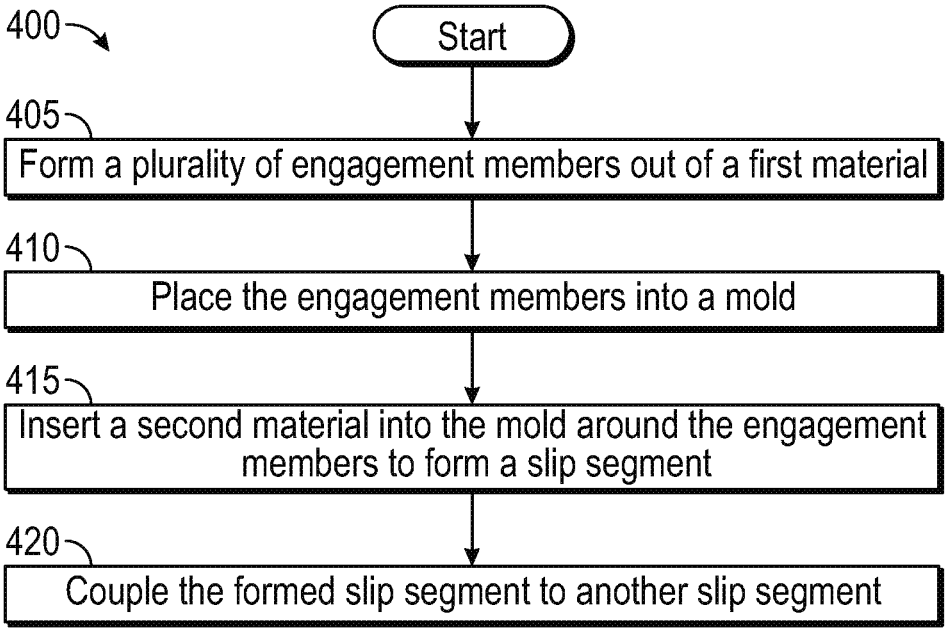
FIG. 17 is a diagram of a method for manufacturing a slip for a downhole sealing device in accordance with at least some embodiments disclosed herein.

Referring now to FIG. 17, a method 400 for forming, producing, or manufacturing a slip (e.g., slips 100, 300) for a downhole sealing device (e.g., device 10) is shown. In explaining the steps of method 400, reference will be made to the slips 100, 300 shown in FIGS. 1-16; however, it should be appreciated that method 400 may be performed to form, produce, or manufacture another slip (i.e., other than slips 100, 300). Thus references to slips 100, 300 are made as a matter of convenience.

Initially, method 300 includes forming a plurality of engagement members (e.g., engagement members 162, 362) out of a first material at 405. The first material may be any suitable material for forming an engagement component of a slip (i.e., a component that will engage with an inner surface 50*a* of a tubular 50 during operations). For example, the first material may be a material suitable for forming a hard component for cutting or engaging with the inner surface (e.g., surface 50*a*) of a downhole tubular (e.g., tubular 50). As a result, in some embodiments, the first material may comprise a metal alloy (e.g., 86-20 Chrome-Nickel-Molybdenum alloy, carbon steel, tungsten carbide, cast iron, and/or tool steel. In other embodiments, the first material may comprise a ceramic material. Forming a plurality of engagement members 362 may comprise any suitable machining or fabrication process such as, for example, casting, sintering, extruding, pressing, cold working, hot working, milling, cutting, grinding, etc.

At 410 the engagement members (e.g., engagement members 162, 362) are installed within a mold or cast. The mold in 410 includes a cavity that substantially conforms to the shape of a slip segment (e.g., slip segment 150, 350) of a slip (e.g., slip 100, 300). Thus, when employing method 400 to manufacture the slip 100 shown in FIG. 1-8, the mold in 410 includes a cavity that includes the sides 150*c*, 150*d*, 152, 154 (and their associate surfaces and features) as described above. Conversely, when employing method 400 to manufacture the slip 300 shown in FIGS. 10-16, the mold in 410 includes a cavity that includes the sides 350*c*, 350*d*, 352, 354 (and their associated surface and features) as described above.

Next, method 400 includes inserting (e.g., pouring, injecting, etc.) at molten, liquid, or semi-liquid second material into the mold at 415 after placing the engagement members therein at 410 to form a slip segment (e.g., slip segment 150, 300). In some embodiments, the second material comprises a molten, liquid, or semi-liquid material. In certain embodiments, the second material may be different from the first material forming the engagement members. Second material may be any suitable material for making up a structural component of a slip (e.g., slip 100, 300). In some embodiments, second material may comprise a lower cost material to reduce the overall costs for the resulting slip. In the embodiments of FIGS. 1-8 and 10-16, the second material (i.e., the material forming all portions of slip segment 150, 350 except for engagement members 162, 362, respectively) comprises zinc or a zinc alloy. However, in other embodiments, the second material may comprise aluminum, magnesium, and alloys thereof. In at least some embodiments, the first material forming the engagement members is harder than the second material after the second material has solidified.

Finally, after the second material inserted within the mold at 415 has solidified (thereby securing the engagement members therein), the slip segment (e.g., slip segments 150, 350) is removed from the mold and may then be coupled to at least one other slip segment that is similarly formed (e.g., formed by the same or similar steps as 405-415) at 420 to form a slip for a downhole sealing device (e.g., device 10). In some embodiments, coupling the slip segments at 420 comprises forming a slip for a downhole sealing device (e.g., device 10). In certain embodiments, the slip segment formed in steps 405-415 is coupled to another similar slip segment by engaging a projection (e.g., projection 156) on one of the slip segments with a corresponding slot (e.g., slot 158) on the other of the slip segments; however, other coupling methods may be used in other embodiments.

In some embodiments, the projection 156 and slot 158 may be tapered to facilitate coupling between the interconnected slip segments (e.g., segments 150, 350). For example, referring now to FIGS. 18 and 19, where another embodiment of a slip segment 550 for forming slip (e.g., slip 100, 300) is shown. Slip segment 550 is substantially the same as slip segment 150. Thus, like parts will be referred to with like reference numerals, and the description below will focus on the features of slip segment 550 that are different from slip segment 150. It should be appreciated that the features of slip segments 550 may be utilized on slip segment 350 as well in other embodiments.

In particular, slip segment 550 comprises a body 557 including first end 550*a* and a second end 550*b* that is opposite first end 550*a*. In addition, slip segment 550 also includes a radially outer side 550*c*, a radially inner side 550*d*, a first lateral side 552, and a second lateral side 554 opposite first lateral side 552. Ends 550*a*, 550*b* and sides 550*c*, 550*d*, 552, 554 correspond to and are generally the same as ends 150*a*, 150*b* and sides 150*c*, 150*d*, 152, 154 of slip segment 150, previously described, except as specifically laid out below.

Figure 19:
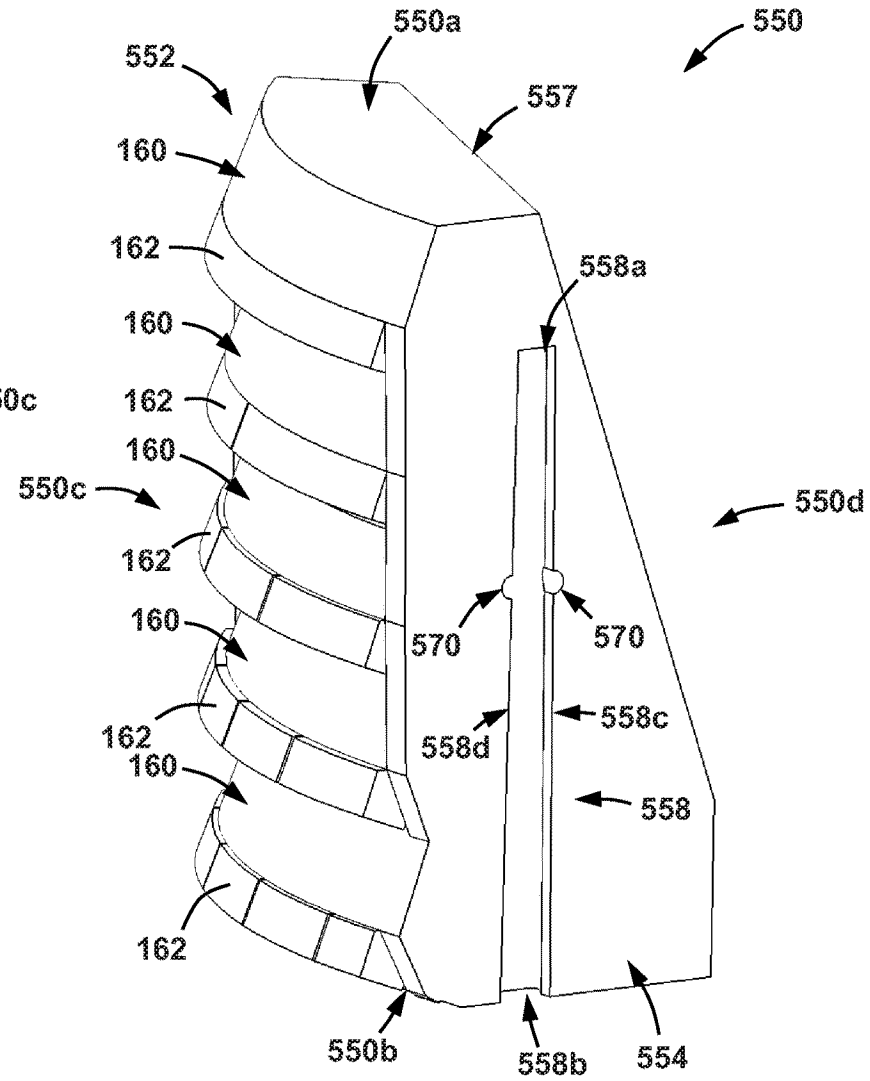
FIGS. 18 and 19 are perspective views of another slip segment in accordance with at least some embodiments disclosed herein.
Figure 18:
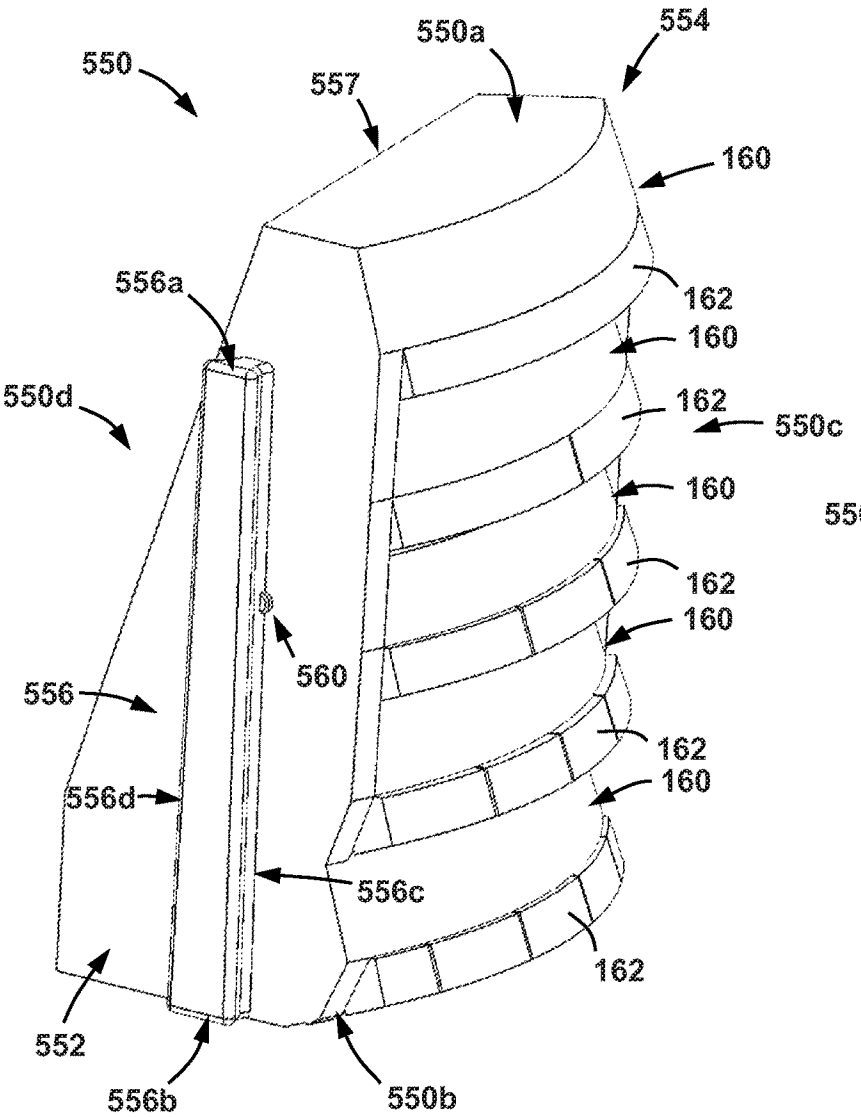

Referring still to FIGS. 18 and 19, first lateral side 552 of body 557 includes an axially extending tenon or projection 556 that includes a first end 556*a* and a second end 556*b* opposite first end 556*a*. Projection 556 is substantially the same as projection 156, previously described, except that projection 556 is tapered between ends 556*a*, 556*b*, and includes a pair of engagement members 560 disposed between ends 556*a*, 556*b*. Specifically, referring briefly to FIG. 21, projection 556 includes a first lateral side 556*c* and a second lateral side 556*d*. The span between sides 556*c*, 556*d* represents the width of projection 556. In this embodiment, the width of projection 556 tapers moving from the second end 556*b* to the first end 556*a* such that the width of projection 556 decreases when moving from second end 556*b* to first end 556*a*. In other words, the sides 556*c*, 556*d* do not extend parallel to one another and are instead disposed at a non-zero angle $\alpha$ relative to one another. In some embodiment, the angle $\alpha$ ranges from 0.5° to 10.0°.

Figure 20:
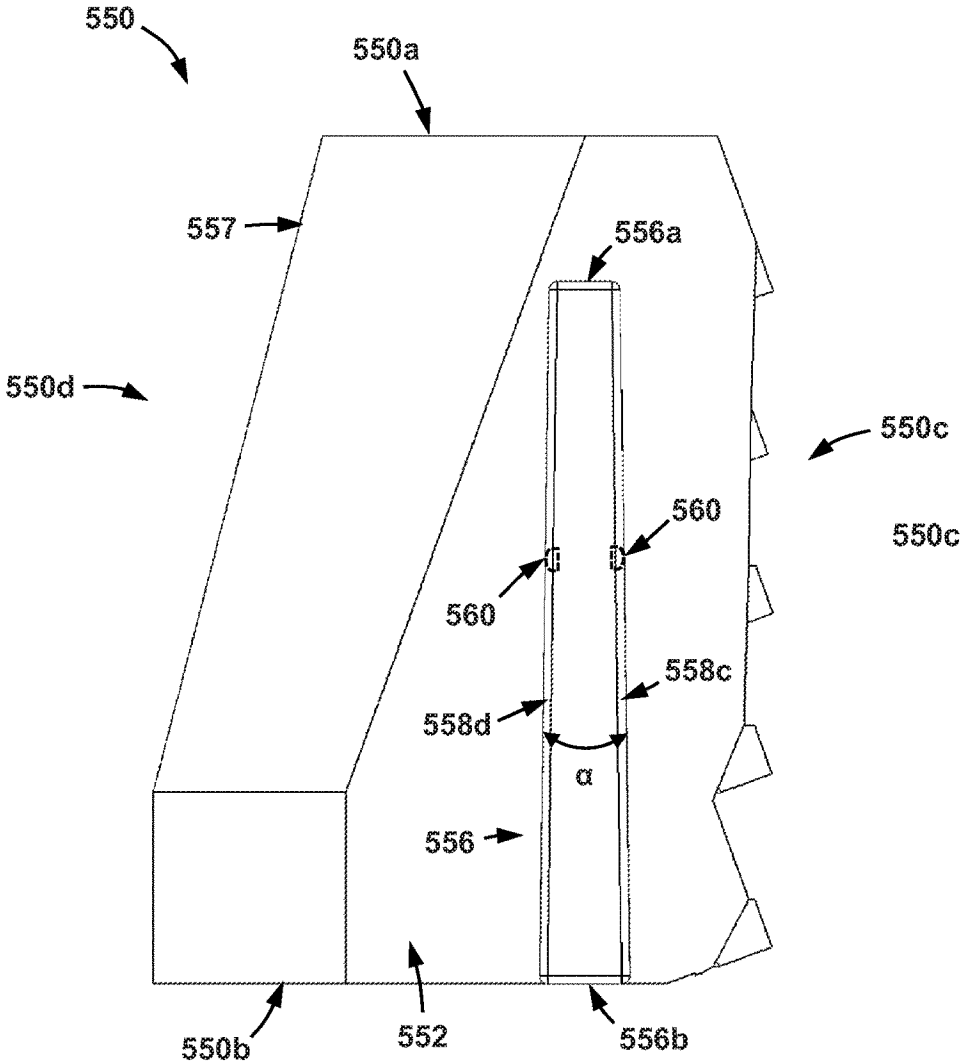

Referring now to FIGS. 18 and 20, in this embodiment, each side 556*c*, 556*d* includes one of the engagement members 560 (note: only engagement member 560 on side 556*c* is visible in FIG. 18). In this embodiment, engagement members 560 each comprise a round projection extending outward from the corresponding side 556*c*, 556*d*. However, it should be appreciated that engagement members 560 may be formed in a wide variety of shapes, such as, for example, rectangular, triangular, polygonal, etc.

Referring again to FIG. 19, second lateral side 554 of slip segment 550 includes an axially extending mortise or slot 558 that includes a first end 558*a*, and a second end 558*b* opposite first end 558*a*. Slot 558 is substantially the same as slot 158, previously described, except that slot 558 is tapered between ends 558*a*, 558*b*, and includes a pair of engagement receptacles 570 disposed between ends 558*a*, 558*b*. Specifically referring briefly to FIG. 22, slot 558 includes a first lateral side 558*c* and a second lateral side 558*d*. The span between sides 558*c*, 558*d* represents the width of slot 558. In this embodiment, width of slot 558 tapers moving from second end 558*b* to first end 558*a* such that the width of slot 558 decreases when moving from second end 558*b* to first end 558*a*. In other words, the sides 558*c*, 558*d* do not extend parallel to one another and are instead disposed at a non-zero angle β relative to one another. In this embodiment, the angle β ranges from 0.5° to 10.0°. In this embodiment, the angle β is the same as the angle α.

Figure 21:
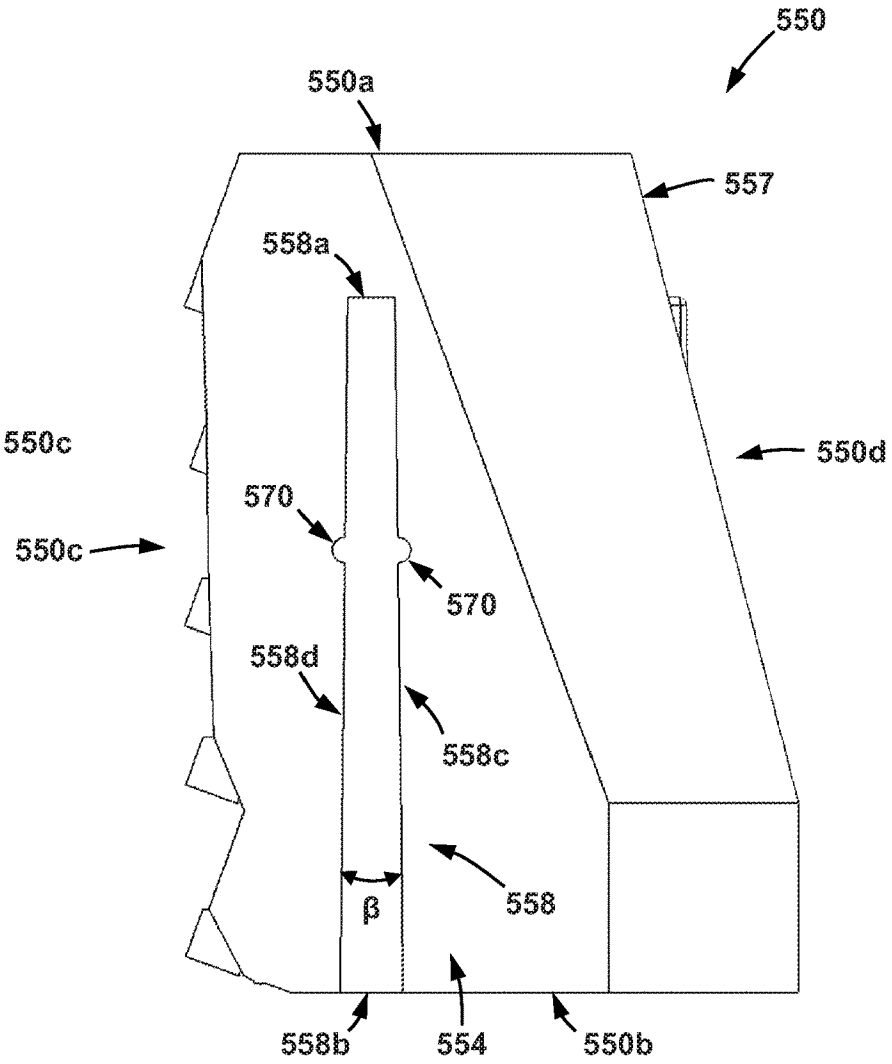
FIGS. 20 and 21 are side views of the slip segment of FIGS. 18 and 19.

Referring now to FIGS. 19 and 21, in this embodiment each side 558*c*, 558*d* includes one of the engagement receptacles 570. In this embodiment, engagement receptacles 570 each comprise a round recess or indentation extending into each corresponding side 558*c*, 558*d*. However, it should be appreciated that engagement receptacles 570 may be formed in a wide variety of shapes, such as, for example, rectangular, triangular, polygonal, etc. In this embodiment, engagement receptacles 570 are shaped and sized to receive the engagement members 560 on the projection 556 of another similarly configured slip segment 550 (e.g., to form a full slip such as slips 100, 300).

Referring now to FIGS. 20 and 21, during operation, a plurality of slip segments 550 are coupled to one another to form a slip (e.g., slips 100, 300). In particular, each slip segment 550 is coupled to an angularly adjacent slip segment 550 about a common axis (e.g., axis 105 of slip 100) by inserting the projection 556 of one of the segments 550 axially within the corresponding slot 558 of the adjacent segment 550. Because the sides 556*c*, 556*d* of projection 556 and the sides 558*c*, 558*d* of slot 558 on each slip segment 550 are disposed at the non-zero angles α, β to one another as previously described, there is an increasing amount of interference as projection 556 is being inserted within the slot 558 of the adjacent slip segment 550. Specifically, a majority of the interference between each projection 556 and slot 558 during these insertion operations occurs between the engagement members 560 and sides 558*c*, 558*d* of slot 558. This interference increases until engagement members 560 are brought into alignment with and therefore are seated within the corresponding engagement receptacles 570. Thereafter, the projection 556 may not be withdrawn from the slot 558 without first unseating engagement members 560 from the engagement receptacles 570 (or more simply fracturing the engagement members 560 from projection 556). In at least some embodiments, engagement member 560 and engagement receptacles 570 are placed along projection 556 and slot 558, respectively, such that the engagement members 560 seat within the engagement receptacles 570 just as or just after engagement members 560 and/or sides 556*c*, 556*d* of projection 556 interfere with sides 558*c*, 558*d* of slot 558 during insertion of projection 556 within slot 558. In this embodiment, the engagement members 560 are disposed more proximate first end 556*a* than second end 556*b* of projection 556, and the engagement receptacles 570 are disposed more proximate first end 558*a* than second end 558*b* of slot 558.

Figure 22:
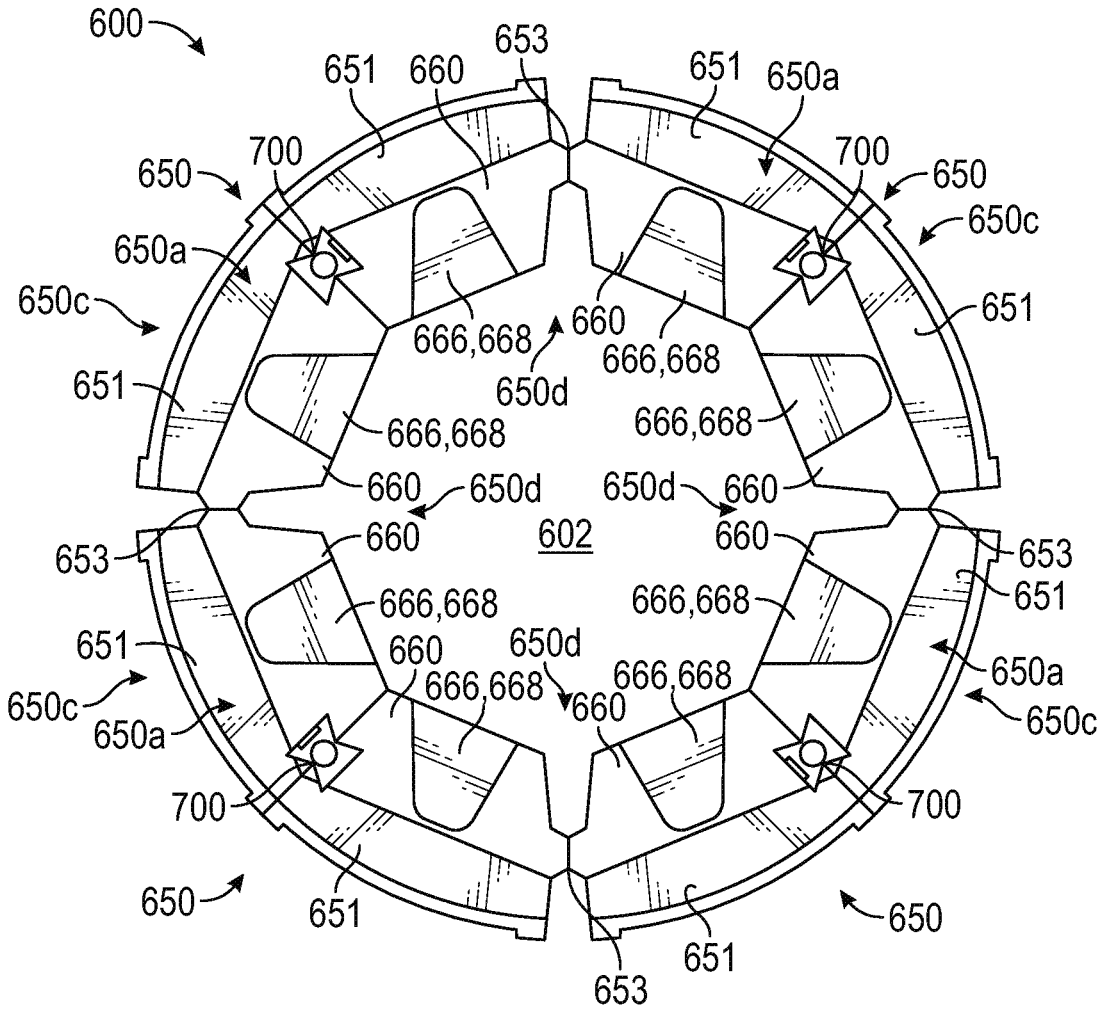
FIG. 22 is a top view of another slip for use with the downhole sealing device of FIG. 1 in accordance with at least some embodiments disclosed herein.
Figure 23:
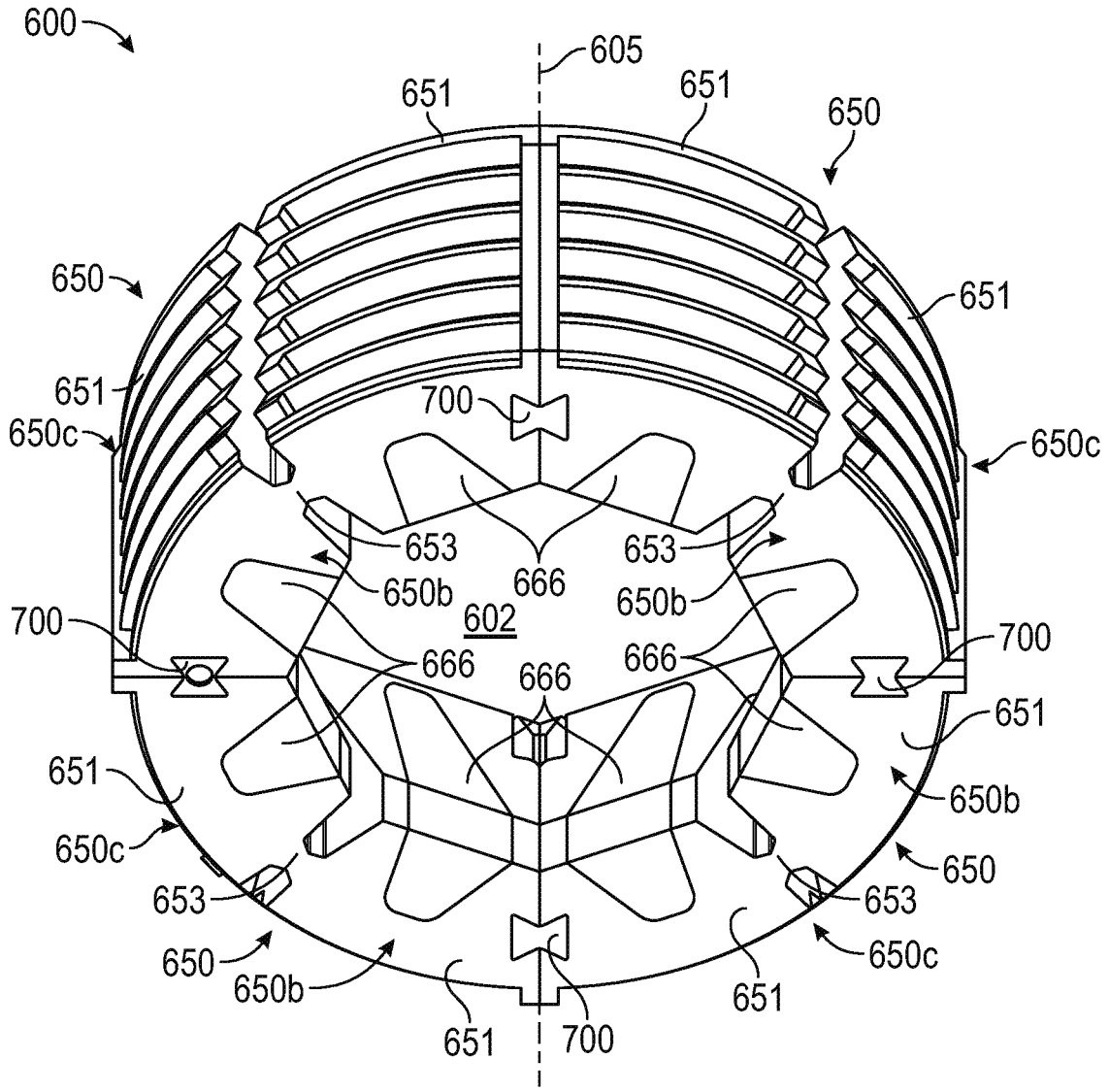
FIG. 23 is a perspective view of the slip of FIG. 22.

Referring now to FIGS. 22 and 23, another embodiment of a slip 600 for use with downhole sealing device 10 in place of slip 100 is shown. Slip 600 is generally similar to slip 100, previously described, and thus, components that are shared among slips 100, 600 are referred to with the same reference numerals, and the description below will focus on the components and features of slip 600 that are different from slip 100. Slip 600 is a ring-shape member that includes a central or longitudinal axis 605 (shown in FIG. 23) that is generally aligned with axis 15 of downhole sealing tool 10 during operations (although such alignment is not required). In addition, slip 600 includes a first end 600*a*, a second end 600*b* opposite first end 600*a*, and a throughbore 602 extending axially between ends 600*a*, 600*b*.

As with slip 100, slip 600 comprises a plurality of individual, discrete slip segments or members 650 that are coupled to one another to form slip 600. Specifically, in this embodiment, slip 600 comprises a total of four (4) slip segments 650 that are symmetrically disposed about axis 605; however, the specific number of slip segments 650 may be varied in to other embodiments (e.g., the number of slip segments 650 may be more or less than four in other embodiments). Slip segments 650 will now be described in more detail below.

Figure 24:
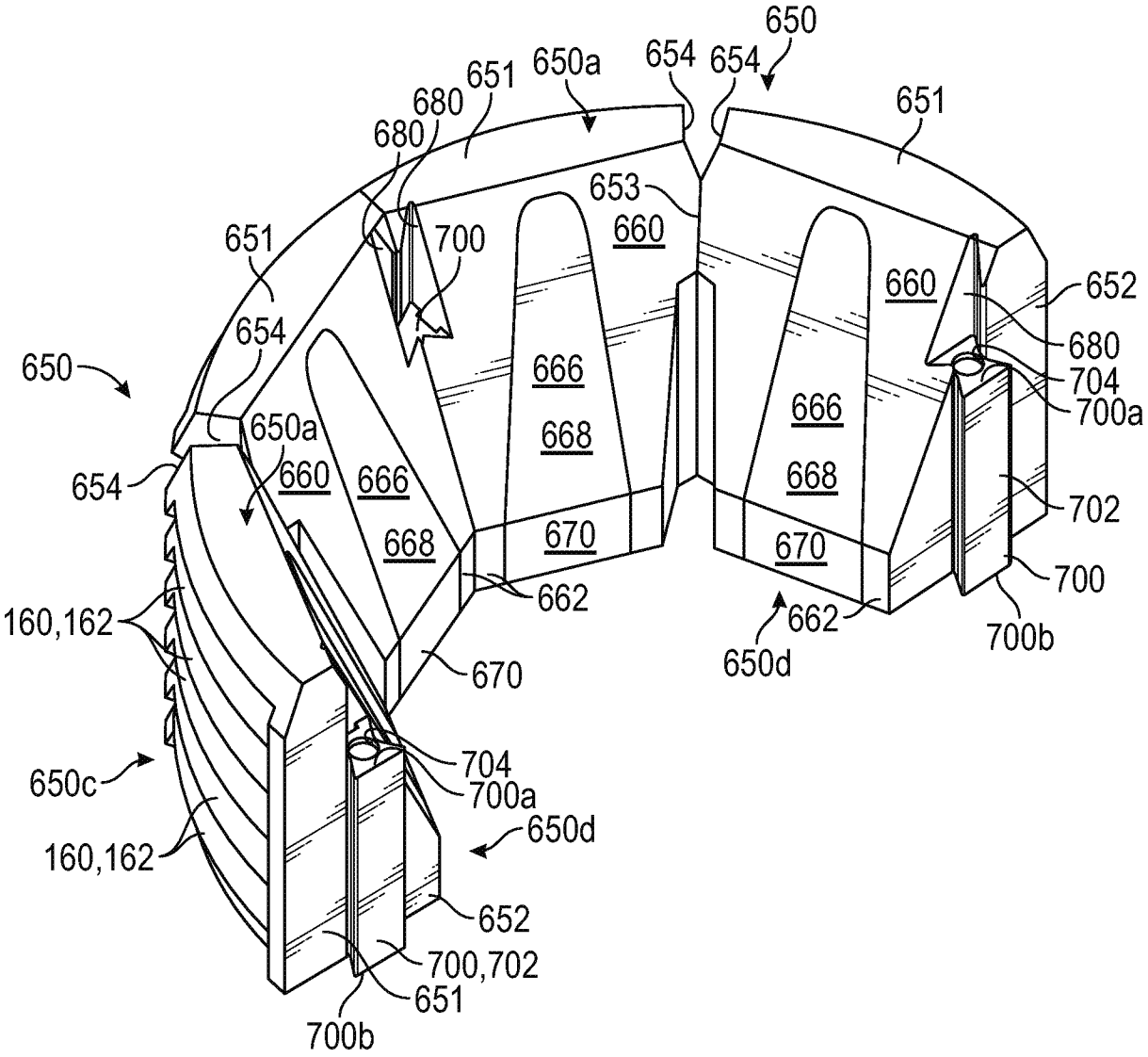
FIGS. 24 and 25 are perspective views of slip segments of the slip of FIGS. 22 and 23.
Figure 25:
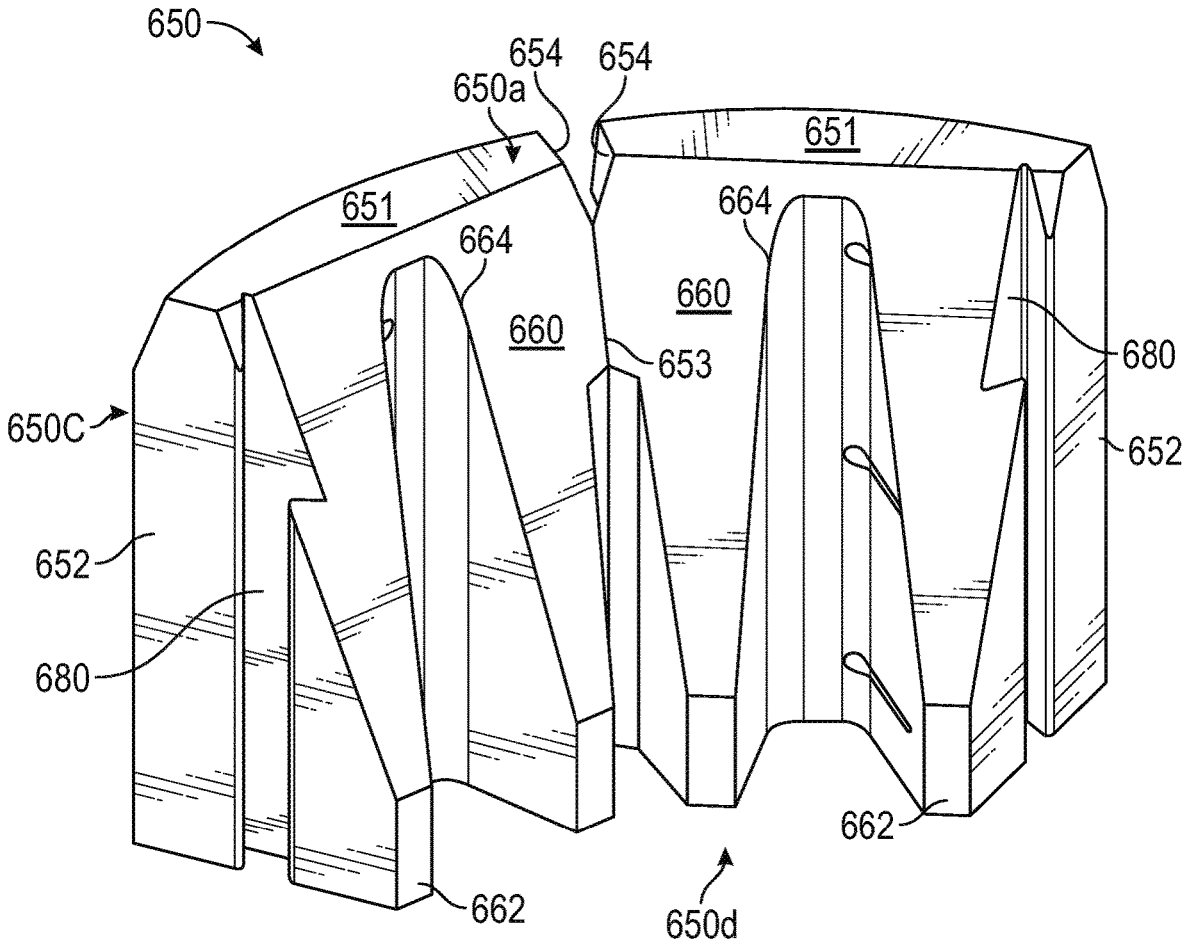
Figure 26:
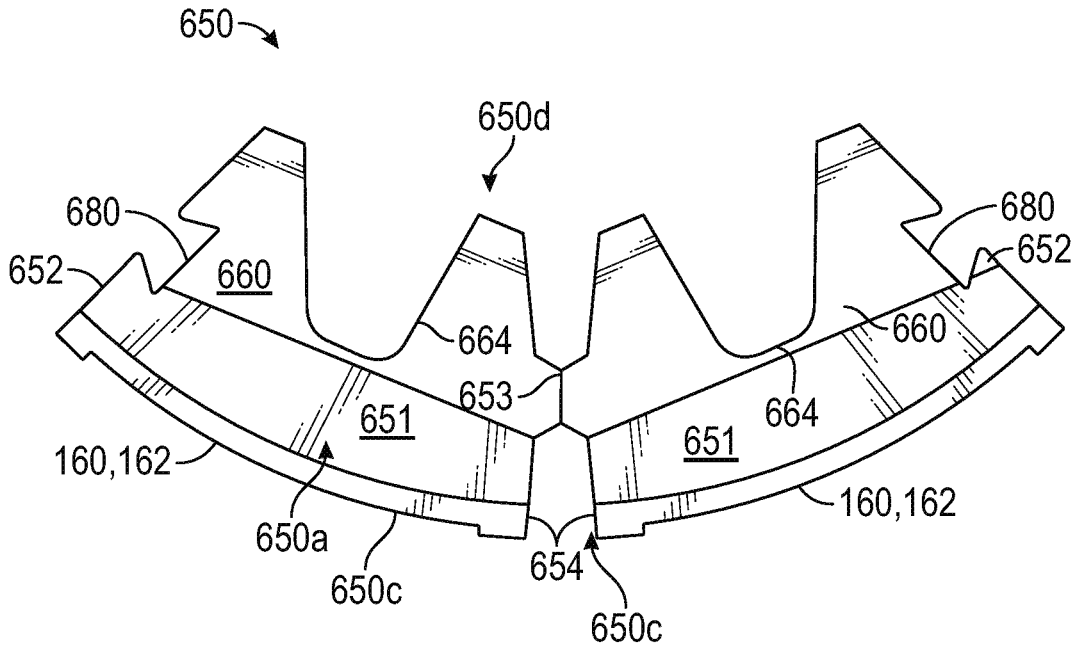
FIG. 26 is a top view of the slip segments of FIGS. 24 and 25.

Referring to FIGS. 22-24, a pair of slip segments 650 of slip 600 are shown in FIG. 24. For clarity, a singular slip segment is discussed below with it being appreciated that each slip segment 650 forming slip 600 is substantially the same. Slip segment 650 generally comprises a pair of bodies 651 joined by a web or engagement member 653 (shown in FIGS. 22 and 23). Slip segment 650 includes a first end 650*a* that is coincident with first end 600*a* of slip 600 when slip segment 650 is incorporated therein, and a second end 650*b* that is opposite first end 650*a* and is coincident with second end 600*b* of slip 600 when slip segment 650 is incorporated therein. In addition, slip segment 650 also includes a radially outer side 650*c* and a radially inner side 650*d*. As shown in FIGS. 22 and 23, radially inner side 650*d* is more proximate axis 605 of slip 600 than radially outer side 650*c* when slip segment 650 is incorporated within slip 600. Further, each body 651 of slip segment 650 includes a first lateral side 652 and a second lateral side 654 opposite first lateral side 652. Each of the lateral sides 652, 654 extend radially with respect to axis 605 between radially outer side 650*c* and radially inner side 650*d* when slip segment 650 is incorporated within slip 600.

In this embodiment, the second lateral side 654 of bodies 651 of slip segment 650 are joined or coupled by a web 653 extending therebetween. Web 653 is disposed radially between radially outer and inner sides 650*c* and 650*d*, respectively, and extends from second end 650*b* to a terminal end 655. Thus, web 653 does not extend entirely between first and second ends 650*a* and 650*b*, respectively, of slip segment 650. Additionally, each web 653 comprises a cross-section formed in a dovetail shape and thus includes a throat or minimum thickness region that extends between second end 650*b* and terminal end 655. In this embodiment, the material making up each body 651 and the web 653 of slip segment 650 is a single monolithic piece (i.e., bodies 651 and web 653 of slip segment 650 are formed of a single, integrated body of material). Bodies 651 of slip segment 650 are described in more detail below. For clarity, a singular body 651 is discussed below with it being appreciated that each body 651 forming slip segment 650 is substantially the same.

Referring to FIGS. 22-26, the radially inner side 650*d* of body 651 includes a first planar surface 660 extending from first end 650*a*, and a second planar surface 662 extending axially between first planar surface 660 and second end 650*b*. When slip segment 650 is incorporated within slip 600, first planar surface 660 of body 651 extends at the angle θ (not shown) relative to axis 605, and second planar surface 662 extends generally parallel to axis 605. In this embodiment, the radially inner side 650*d* of body 651 also includes a partially cylindrical recess or aperture 664 (shown in FIGS. 25 and 26) extending axially (i.e., extending parallel axis 605) therein that receives a corresponding insert 666 (shown in FIGS. 22-24). Insert 666 also includes a first planar surface 668 extending from a first or upper end thereof and a second planar surface 670 extending from a second or lower end thereof. When insert 666 is received in aperture 664 of body 651 and the slip segment 650 of body 651 is incorporated within slip 600, first planar surface 668 of insert 666 extends at the angle θ (not shown) relative to axis 605, and second planar surface 670 extends generally parallel to axis 605. Additionally, when insert 666 is received in the aperture 664 of body 651 the first planar surface 668 is substantially flush with first planar surface 660 and second planar surface 670 is substantially flush with second planar surface 662.

During assembly of slip segment 650, the insert 666 of each body 651 is inserted axially into its corresponding receptacle 664. In this embodiment, an adhesive is applied to either a surface of receptacle 664 or insert 666 prior to inserting the insert 666 therein to secure insert 666 within receptacle 664. However, in other embodiments, receptacle 664 and/or insert 666 may include mechanical coupling members or features configured to form a mechanical connection between body 651 and its respective insert 666. For instance, in some embodiments, a tongue and groove or dovetail profile connection (e.g., a connection similar to that formed between projection 156 and slot 158 of slip segments 150, etc.) may be formed between insert 666 and receptacle 664. In some embodiments, the bodies 651 of each slip segment 650 may comprise a first material while inserts 666 of the slip segment 650 comprises a second material that may vary from the first material. In some embodiments, inserts 666 are formed from a material comprising composite or plastic. In some embodiments, inserts 666 are formed from a material comprising zinc, aluminum, magnesium, and alloys thereof, as well as other metals and metal alloys. In some applications, the inclusion of insert 666 assists in the manufacturing process of slip segment 650, such as in manufacturing processes similar to the process described above with respect to method 200.

Referring to FIGS. 22-27, slip 600 includes an engagement or locking member 700 (shown in FIGS. 22-24 and 26) releasably coupled between each adjacently disposed pair of slip segments 650 configured to releasably couple the slip segments 650. In this embodiment, locking member 700 is separate and distinct from the bodies 651 of slip segment 650. Thus, instead of relying on a tenon or projection monolithically formed with each slip segment, slip 600 includes separate locking members 700 for releasably coupling adjacently disposed slip segments 650. The first lateral side 652 of body 651 includes a mortise or slot 680 extending axially between first end 650*a* and second end 650*b*, and formed in a dovetail shape.

Figure 27:
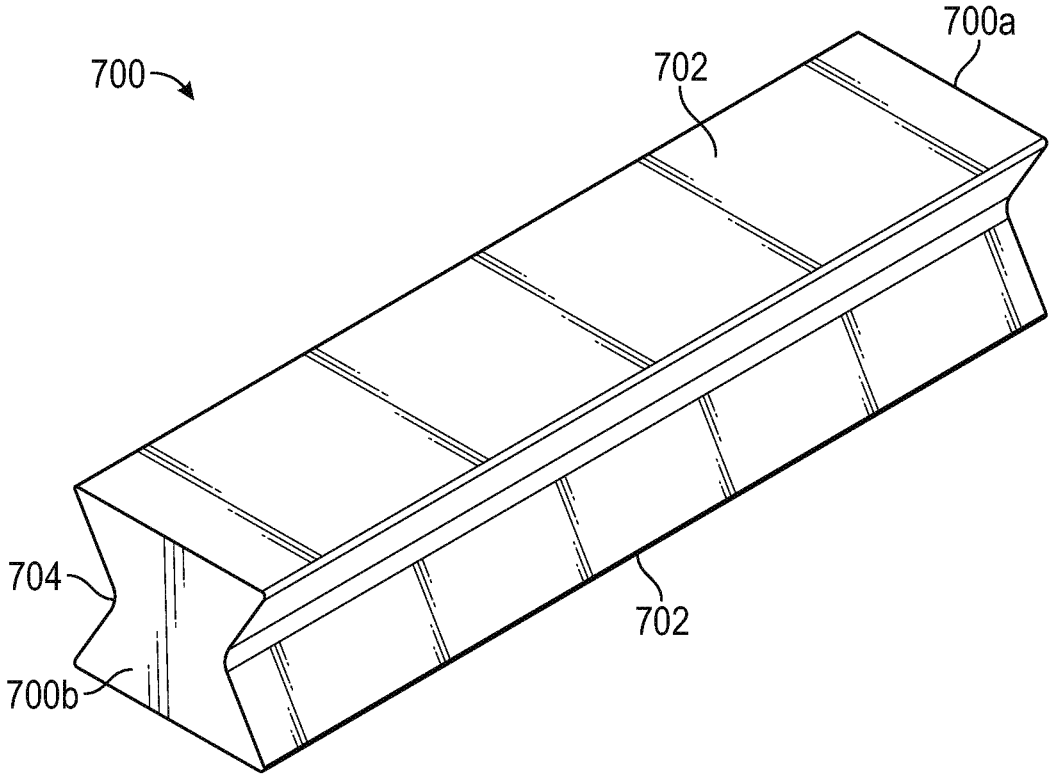
FIG. 27 is a perspective view of a locking member of the slip of FIGS. 22 and 23.

As best shown in FIG. 27, locking member 700 includes a first end 700*a* and a second end 700*b* opposite first end 700*a*. Locking member 700 includes a pair of dovetail shapes or engagement profiles 702 extending in opposite lateral directions from a throat or minimum thickness region 704. In other words, the throat 704 is disposed between the pair of dovetail profiles 702. In this arrangement, each dovetail profile 702 of locking member 700 is shaped to correspond with the shape of slot 680 of body 651, allowing a first dovetail profile 702 of locking member 700 to be received in the slot 680 of a first body 651 and a second dovetail profile 702 of locking member 700 to be received in the slot 680 of an adjacently disposed body 651, thereby releasably coupling the adjacently disposed bodies 651 with the locking member 700. Additionally, in this embodiment, the axial length of member 700 between ends 700*a* and 700*b* is less than the axial length of slot 680 between ends 650*a* and 650*b* of slip segment 650. In some embodiments, body 651 may comprise a first material while locking member 700 comprises a second material that may vary from the first material. In some embodiments, locking member 700 is formed from a material comprising composite or plastic. In some embodiments, locking member 700 is formed from a material comprising zinc, aluminum, magnesium, and alloys thereof, as well as other metals and metal alloys.

In the embodiment shown in FIGS. 22-27, during assembly of slip 600, each of the slip segments 650 are symmetrically arranged and coupled to one another to form slip 600. In particular, slip segments 650 are arranged about axis 605 such that the first lateral end 652 of each body 651 abuts the first lateral end 652 an adjacently disposed body 651. Each slip segment 650 is then coupled to an angularly adjacent slip segment 650 by axially inserting a locking member 700 into the slots 680 of adjacently disposed bodies 651. In some embodiments, adhesive is applied to either locking member 700 or the slot 680 in which locking member 700 is received to secure locking member 700 within slot 680. In other embodiments, locking member 700 may be mechanically coupled to slot 680. For instance, detents or engagement members, such as the engagement members 560 of slip segment 550 described above, may be used to mechanically secure locking member 700 in its corresponding slot 680. In some embodiments, the width of engagement profiles 702 of locking member may be tapered along the axial length of member 700 (e.g., similar to the tapering of projection 556 described above) and the width of slot 680 may be tapered along its axial length (e.g., similar to the tapering of slot 580 described above) to thereby provide an increasing amount of interference as locking member 700 is axially inserted within slot 680. In still other embodiments, both detents and tapering may be used to secure locking member 700 within slot 680.

In the manner described by constructing a slip (e.g., slips 100, 300) for a downhole sealing device (e.g., device 10) out of a plurality of discrete independent slip segments (e.g., slip segments 150, 350) the manufacturing time for such a slip may be decreased such that the costs for such components may also be decreased. Thus, through use of a slip (e.g., slips 100, 300) and manufacturing method therefor (e.g., methods 200, 400) as described herein, the costs for performing well plugging or isolation operations may be decreased.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A slip for a downhole sealing device, comprising:

a plurality of slip segments angularly disposed about a central axis, each slip segment including:

a plurality of bodies, wherein each body comprises a first end, a second end opposite the first end, a radially outer and extending from the first end to the second end, and a radially inner end extending from the first end to the second end and positioned between the radially outer end and the central axis, and wherein the radially inner end of at least one of the plurality of bodies comprises a first engagement surface, a second engagement surface, and a receptacle;

a web extending between the plurality of bodies, the web monolithically formed with each of the plurality of bodies;

a plurality of engagement members molded or cast at least partially within the radially outer end of each of the plurality of bodies; and an insert received within the receptacle of the at least one of the plurality of bodies, wherein the insert comprises a first planar surface flush with the first engagement surface and a second planar surface that extends at a non-zero angle relative to the first planar surface and which is flush with the second engagement surface;

wherein each of the slip segments are releasably coupled to one another.

2. The slip of claim 1, wherein at least one of the engagement members is formed of a first material, and each of the plurality of bodies is formed of a second material that is different from the first material.

3. The slip of claim 1, wherein at least one of the engagement members comprises an arcuate segment.

4. The slip of claim 1, wherein at least one of the engagement members comprises:

a cylindrical head including a planar engagement surface; and a base;

wherein the base is embedded within at least one of the plurality of bodies; and wherein the planar engagement surface is disposed outside of the at least one of the plurality of bodies.

5. The slip of claim 4, wherein at least one of the engagement members comprises a longitudinal member axis that extends radially with respect to the central axis;

wherein the planar engagement surface is disposed at an angle less than 90° with respect to the member axis.

6. The slip of claim 1, wherein at least one of the plurality of bodies of each slip segment comprises a projection extending axially with respect to the central axis;

wherein at least one the plurality of bodies of each slip segment includes a slot extending axially with respect to the central axis; and wherein the projection of each slip segment is disposed in the slot of another of the slip segments.

7. The slip of claim 6, wherein the projection and the slot of the plurality of bodies of each slip segment is dovetail shaped.

8. The slip of claim 6, wherein the projection of each slip segment is tapered; and wherein the slot of each slip segment is tapered.

9. The slip of claim 8, wherein the projection of each slip segment includes an engagement member extending outward from a lateral side of the projection;

wherein the slot of each slip segment includes an engagement receptacle extending inward from a lateral side of the slot; and wherein when the projection of each slip segment is inserted into the slot of another of the slip segments, the engagement member on the projection is seated within the engagement receptacle in the slot.

10. A slip for a downhole sealing device, comprising:

a plurality of separate and distinct slip segments angularly disposed about a central axis, each slip segment comprising:

a body formed of a first material, wherein the body comprises an outer surface and an inner surface located between the outer surface and the central axis; and a first arcuate engagement member and a second arcuate engagement member separate and distinct from the first arcuate engagement member, the first arcuate engagement member and the second engagement member each embedded within the outer surface of the body whereby relative movement between the body and the first arcuate engagement member and the second arcuate engagement member is prevented, and wherein the second arcuate engagement member is formed of a second material that is different from the first material.

11. The slip of claim 10, wherein the first material is harder than the second material.

12. The slip of claim 10, wherein each of the first arcuate engagement member and the second arcuate engagement member extends arcuately about the central axis.

13. The slip of claim 10, wherein the body of each slip segment includes a projection extending axially with respect to the central axis;

wherein the body of each slip segment includes a slot extending axially with respect to the central axis; and wherein the projection of each slip segment is disposed in the slot of another of the slip segments.

14. The slip of claim 13, wherein:

the projection and the slot of each slip segment are each tapered;

the projection of each slip segment includes an engagement member extending outward from a lateral side of the projection;

the slot of each slip segment includes an engagement receptacle extending inward from a lateral side of the slot; and when the projection of each slip segment is inserted into the slot of another of the slip segments, the engagement member on the projection is seated within the engagement receptacle in the slot.

15. The slip of claim 10, further comprising:

a plurality of elongate locking members;

wherein the body of each slip segment includes a slot extending axially with respect to the central axis; and wherein the locking members are inserted into the slot of each slip segment.

16. The slip of claim 15, wherein:

each locking member comprises a pair of dovetail profiles and a throat disposed between the dovetail profiles; and one of the dovetail profiles of the locking members is inserted into the slot of each slip segment.

17. A method for manufacturing a slip for a downhole sealing device, the method comprising:

(a) forming a plurality of engagement members from a first material;

(b) placing the engagement members into a mold;

(c) inserting a second material into the mold around the engagement members to form a slip segment; and (d) coupling the slip segment formed during (c) to another slip segment;

wherein (a) comprises:

(a1) cutting a plurality of rings from the first material;

(a2) cutting each ring into a plurality of arcuate segments; and (a3) cutting one or more grooves into one or more of the arcuate segments.

18. The method of claim 17, wherein (c) comprises pouring a molten material into the mold.

19. The method of claim 18, wherein the second material includes at least one of zinc, composite, and plastic.

20. The method of claim 17, wherein (d) comprises inserting a projection on the slip segment into a slot of another slip segment.

21. The method of claim 17, wherein (d) comprises axially inserting a separate locking member into a slot of each slip segment.

* * * * *